US011311757B2

(12) United States Patent
Montgomery et al.

(10) Patent No.: US 11,311,757 B2
(45) Date of Patent: Apr. 26, 2022

(54) POSTS FOR USE IN FALL PROTECTION

(71) Applicant: Honeywell International Inc., Morris Plains, NJ (US)

(72) Inventors: Brian C. Montgomery, Mercer, PA (US); Justin Shane Patton, Franklin, PA (US); Preston L. Anderson, Cranberry, PA (US)

(73) Assignee: Honeywell International Inc., Morris Plains, NJ (US)

( * ) Notice: Subject to any disclaimer, the term of this patent is extended or adjusted under 35 U.S.C. 154(b) by 0 days.

(21) Appl. No.: 16/749,868

(22) Filed: Jan. 22, 2020

(65) Prior Publication Data

US 2020/0155880 A1 May 21, 2020

Related U.S. Application Data

(62) Division of application No. 14/128,427, filed as application No. PCT/US2012/043209 on Jun. 20, 2012, now Pat. No. 10,569,111.

(60) Provisional application No. 61/500,414, filed on Jun. 23, 2011.

(51) Int. Cl.
*A62B 35/04* (2006.01)
*A62B 35/00* (2006.01)

(52) U.S. Cl.
CPC ..... *A62B 35/04* (2013.01); *A62B 35/0068* (2013.01); *A62B 35/0093* (2013.01)

(58) Field of Classification Search
CPC .. A62B 35/04; A62B 35/0068; A62B 35/0093
See application file for complete search history.

(56) References Cited

U.S. PATENT DOCUMENTS 4,607,724 A 8/1986 Hillberg
5,029,670 A 7/1991 Whitmer
(Continued)

FOREIGN PATENT DOCUMENTS

EP 1500755 A1 1/2005
EP 1632271 A1 * 3/2006 ..... A62B 35/04
(Continued)

OTHER PUBLICATIONS

Advisory Action (PTOL-303) dated Jan. 29, 2019 for U.S. Appl. No. 14/128,427.
(Continued)

*Primary Examiner* — Alvin C Chin-Shue
(74) *Attorney, Agent, or Firm* — Alston & Bird LLP

(57) ABSTRACT

A post system for use in fall protection includes a connector to connect to a structure and a support in operative connection with a lifeline to maintain the lifeline at a first height above the structure. When a first threshold force is experienced on the lifeline, the support is operable to lower the lifeline to a second height which is lower than the first height. The ratio of a change in effective length of the lifeline resulting from the lowering of the lifeline to a change in height resulting from lowering of the lifeline (or the $\Delta L/\Delta H$ ratio) is less than 1. The ratio of the change in effective length of the lifeline resulting from the lowering of the lifeline to the change in height resulting from lowering of the lifeline may also be less than 0.5 or less than 0.4.

17 Claims, 26 Drawing Sheets

(56) References Cited

U.S. PATENT DOCUMENTS

| | | | | |
|---|---|---|---|---|
| 5,332,071 | A * | 7/1994 | Duncan | A62B 35/04 188/371 |
| 5,799,760 | A * | 9/1998 | Small | A62B 35/04 182/3 |
| 6,173,809 | B1 | 1/2001 | Cole et al. | |
| 6,279,680 | B1 * | 8/2001 | Casebolt | A62B 35/0087 182/18 |
| 6,412,230 | B1 | 7/2002 | Zambelli et al. | |
| 6,412,598 | B1 | 7/2002 | Mackinnon | |
| 6,478,111 | B2 | 11/2002 | Olson et al. | |
| 7,207,414 | B2 * | 4/2007 | Luke | A62B 35/0056 182/3 |
| 7,461,727 | B2 * | 12/2008 | Renton | A62B 35/04 188/371 |
| 8,025,125 | B2 | 9/2011 | Vetesnik et al. | |
| 9,387,351 | B2 | 7/2016 | Auston et al. | |
| 10,569,111 | B2 | 2/2020 | Montgomery et al. | |
| 2004/0256176 | A1 * | 12/2004 | Argoud | A62B 35/04 182/45 |
| 2005/0284693 | A1 | 12/2005 | Rhodes | |
| 2008/0251320 | A1 * | 10/2008 | Lara | A62B 35/04 182/192 |
| 2009/0194366 | A1 * | 8/2009 | Parker | A62B 35/04 182/3 |
| 2013/0168528 | A1 * | 7/2013 | Patton | F16F 7/126 248/548 |

FOREIGN PATENT DOCUMENTS

| | | | | |
|---|---|---|---|---|
| EP | 1693533 | A1 | 8/2006 | |
| FR | 2832751 | A1 * | 5/2003 | E04G 21/3276 |
| WO | 2005/044384 | A1 | 5/2005 | |
| WO | 2005/079922 | A1 | 9/2005 | |

OTHER PUBLICATIONS

Decision on Appeal for U.S. Appl. No. 14/128,427, dated Sep. 29, 2017, 13 pages.
Decision on Request for Rehearing for U.S. Appl. No. 14/128,427, dated Mar. 2, 2018, 5 pages.
Examiner's Answer for U.S. Appl. No. 14/128,427, dated Sep. 15, 2016, 33 pages.
Final Rejection dated Dec. 11, 2015 for U.S. Appl. No. 14/128,427.
Final Rejection dated Oct. 9, 2018 for U.S. Appl. No. 14/128,427.
International Search Report and Written Opinion for International Application No. PCT/US2012/043209 filed Jun. 20, 2012, 9 pages.
Non-Final Rejection dated Apr. 3, 2018 for U.S. Appl. No. 14/128,427.
Non-Final Rejection dated Jul. 10, 2015 for U.S. Appl. No. 14/128,427.
Non-Final Rejection dated Mar. 5, 2019 for U.S. Appl. No. 14/128,427.
Notice of Allowance and Fees Due (PTOL-85) dated Jun. 19, 2019 for U.S. Appl. No. 14/128,427.
Notice of Allowance and Fees Due (PTOL-85) dated Oct. 30, 2019 for U.S. Appl. No. 14/128,427.
Requirement for Restriction/Election dated Apr. 30, 2015 for U.S. Appl. No. 14/128,427.
Requirement for Restriction/Election dated Dec. 23, 2014 for U.S. Appl. No. 14/128,427.
U.S. Appl. No. 14/128,427, filed Dec. 20, 2013, U.S. Pat. No. 10,569,111.

* cited by examiner

Fig. 1B
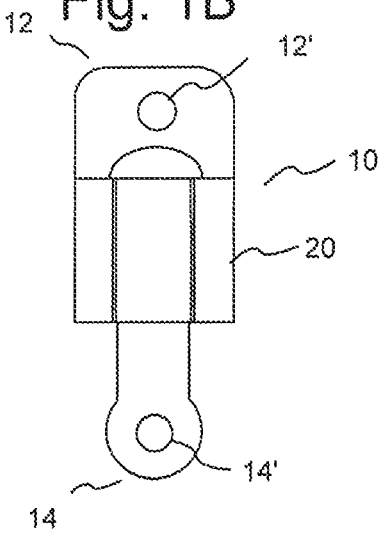
PRIOR ART
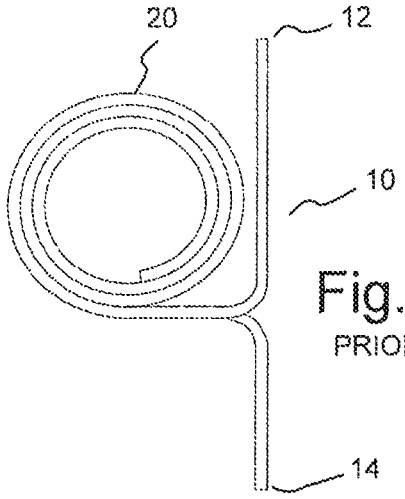
Fig. 1A
PRIOR ART
Fig. 1C
PRIOR ART
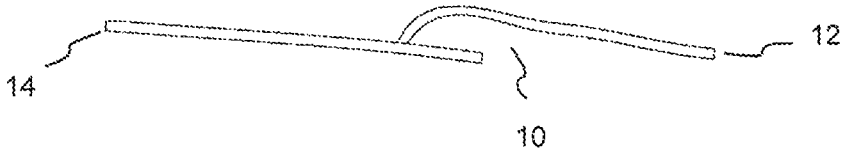
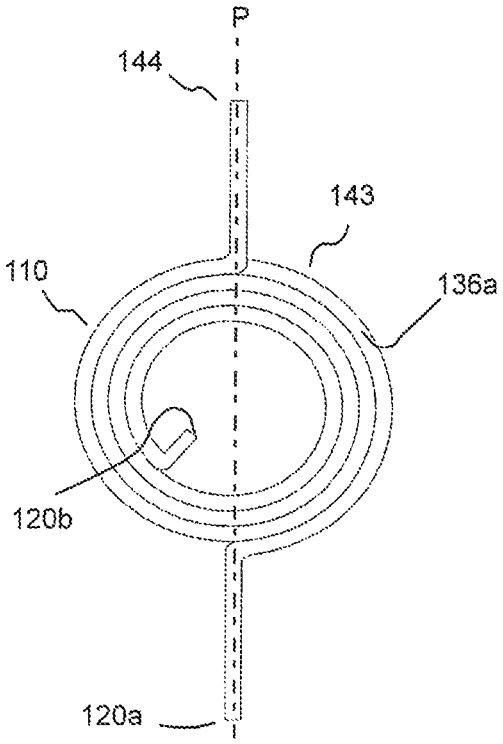
Fig. 2A
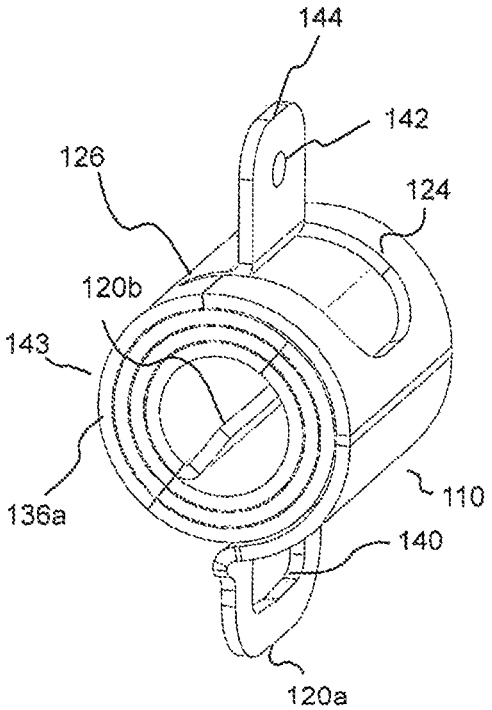
Fig. 2B Fig. 3A
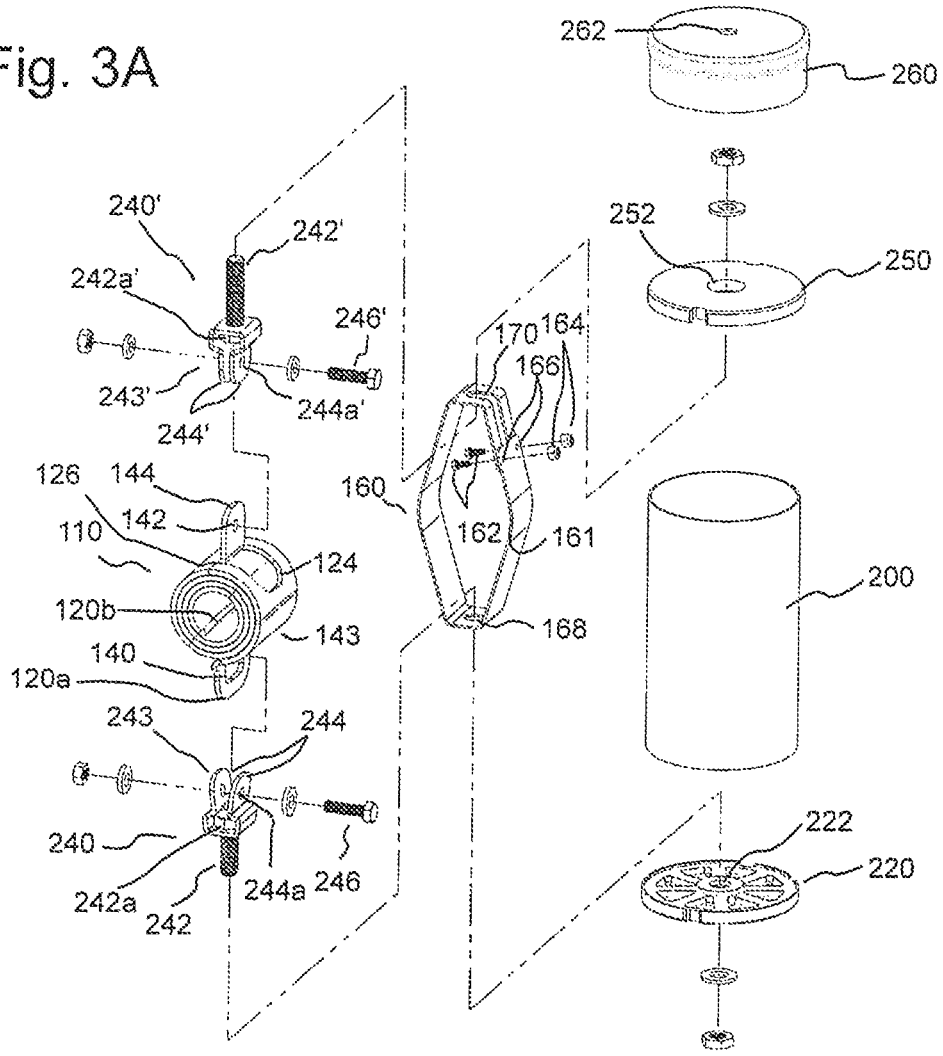
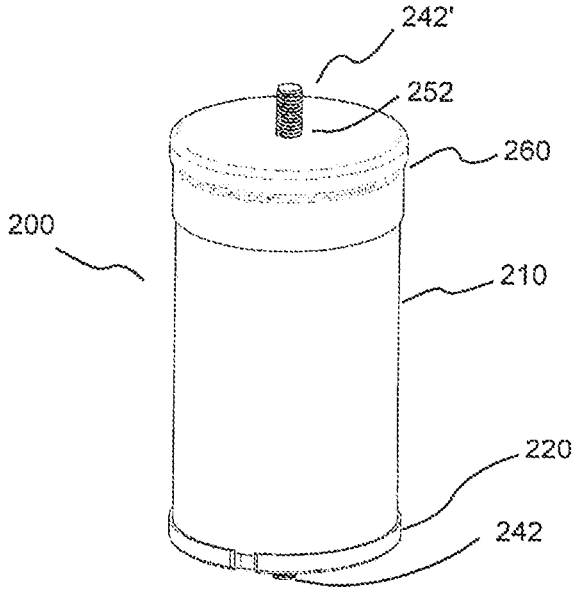
Fig. 3B Fig. 12C
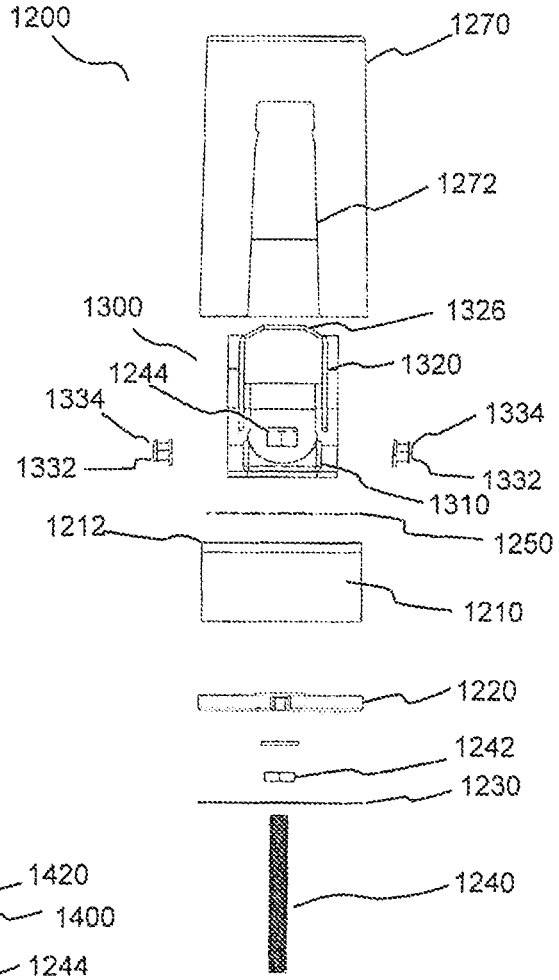
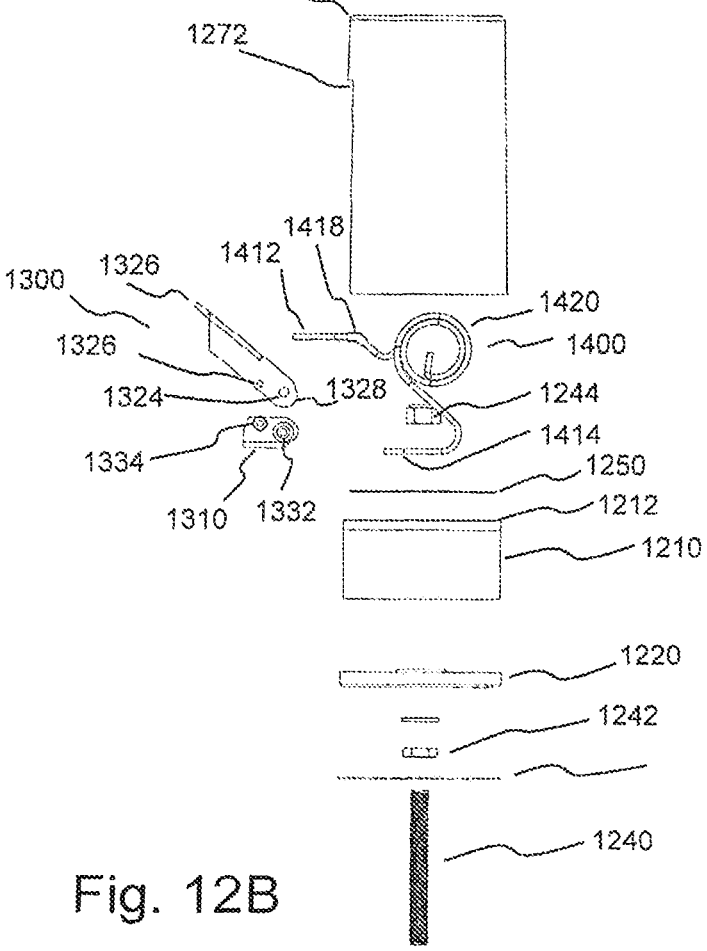
Fig. 12B

POSTS FOR USE IN FALL PROTECTION

CROSS-REFERENCE TO RELATED APPLICATIONS

This application is a Division of concurrently pending U.S. application Ser. No. 14/128,427, filed Dec. 20, 2013 and entitled "Posts for Use in Fall Protection," which was a National Phase Entry of International Application No. PCT/US2012/043209, filed Jun. 20, 2012 and entitled "Posts for Use in Fall Protection," which claims priority to and the benefit of U.S. Provisional Application No. 61/500,414, filed Jun. 23, 2011 and entitled "Posts for Use in Fall Protection," the entire disclosure of each of which are hereby incorporated herein by reference in their entireties for all purposes.

BACKGROUND

The following information is provided to assist the reader to understand the technology described below and certain environments in which such technology can be used. The terms used herein are not intended to be limited to any particular narrow interpretation unless clearly stated otherwise in this document. References set forth herein may facilitate understanding of the technology or the background thereof. The disclosure of all references cited herein are incorporated by reference.

Shock absorbing devices and system are used in a variety of systems to, for example, protect structures, equipment and/or persons from experiencing excessive force.

In the case of, for example, fall protection devices and system, shock absorbing devices can be used to protect anchorage points or structures, fall protection equipment and/or a user of the fall protection equipment. In the case of a worker on an elevated structure such as a roof, one or more shock absorbers can, for example, be used in connection with one or more posts that can be used individually as an anchorage or collectively in a horizontal lifeline system. Whether used individually or in a horizontal lifeline system, such posts raise a lifeline attached to a user above the roof structure (to, for example, facilitate use thereof), and can lead to relatively high torque or moment forces upon the roof structure in the case of a fall. In a number of systems posts are designed to "tilt" or "tip over" upon experiencing a force above a threshold force or load (for example, associated with a fall), thereby reducing torque and reducing or minimizing damage to the roof or other structure. An energy absorbing system can also be used in connection with such a post to further limit forces upon the roof or other structure as well as to reduce force experienced by the user.

SUMMARY

In one aspect, a post system for use in fall protection includes a connector to connect to a structure and a support in operative connection with a lifeline to maintain the lifeline at a first height above the structure. When a first threshold force is experienced on the lifeline, the support is operable to lower the lifeline to a second height which is lower than the first height. The ratio of a change in effective length of the lifeline resulting from the lowering of the lifeline to a change in height resulting from lowering of the lifeline (or the $\Delta L/\Delta H$ ratio) is less than 1. The ratio of the change in effective length of the lifeline resulting from the lowering of the lifeline to the change in height resulting from lowering of the lifeline may also be less than 0.5 or less than 0.4.

In a number of embodiments, the support includes a moveable member to which the lifeline is connected. The movable member moves relative to the structure upon the lifeline experiencing the first threshold force to lower the lifeline to the second height. The moveable member may, for example, pivot from a first position to a second position upon the lifeline experiencing the threshold force to lower the lifeline to the second height. The moveable member may, for example, be maintained in the first position by at least one breakable connector which breaks upon the lifeline experiencing the first threshold force to enable the moveable member to move (for example, pivot) to the second position.

The post system may further include at least one energy absorber operatively connected to the lifeline. The energy absorber may, for example, include a metal strap including a first end section, a second end section, and an intermediate section between the first end section and the second end section. The strap may further include a generally U-shaped slot passing through the strap in the first end section that separates the first end section into a first connector section and a second connector section. The first connector section and the second connector section are deformed to extend in different directions away from one another. A portion of the intermediate portion of the strap is coiled in a spiral fashion inside a remainder of the intermediate portion of the strap. The first connector section may, for example, be connected to the lifeline, and the second connector section may, for example, be in operative connection with the structure. In a number of embodiments, the intermediate portion begins to tear or to uncoil at a second threshold force that is greater than the first threshold force. At least a portion of the energy absorber may, for example, be positioned on the movable member.

In a number of embodiments, the post system further includes a post member connected to the structure via the connector and extending from the structure. The support may, for example, include a stationary member attached to the post member. As described above, in a number of embodiments, the moveable member is pivotably connected to the stationary member.

In several embodiments, the first connector section of the energy absorber extends over a first end of the movable member to connect to the lifeline, and a second end of the movable member is pivotably connected to the stationary member. The second connector section may, for example, extend around the second end of the movable member and between the stationary member and the post member. The second connector section and stationary member may, for example, be connected to the post member via a connector passing through a passage in the second connector section and through a passage in the stationary member.

In another aspect, a horizontal lifeline system includes a lifeline and at least one post system as described above. The horizontal lifeline may further include at least one intermediate post system comprising an extending post member having a $\Delta L/\Delta H$ ratio greater than or equal to 1. In a number of embodiments, the intermediated post system supports the lifeline at a height greater than the first height before the threshold force is experienced.

In a number of embodiments, the intermediate post system having a $\Delta L/\Delta H$ ratio greater than or equal to 1 is positioned along the lifeline at a position wherein the lifeline forms an angle of less than a predetermined angle.

The intermediate post system having a $\Delta L/\Delta H$ ratio greater than or equal to 1 may, for example, include a tilting or tipping post member.

In another aspect, a post system for use in fall protection includes an extending post member, a first end member in operative connection with a first end of the extending post member, a second end member in operative connection with a second end of the extending post member, a first connector in operative connection with the first end member to connect a lifeline system to the first connector, a second connector in operative connection with the second end member to connect the second end member to a structure; and at least one energy absorber system in operative connection between the first end member and the second end member. The energy absorber system includes an actuator including band of material and an energy absorber. The band of material is in operative connection with the first connector and the second connector. A tensile force of a threshold magnitude is required between the first end member and the second end member to open the band. Upon opening of the band, the extending post member is able to tilt relative to the second end member and the energy absorber is free to deform under tensile force to absorb energy.

The energy absorber can, for example, include or be formed, at least in part, from a metal strap including a first end section, a second end section, and an intermediate section between the first end section and the second end section. The strap can, for example, include a generally U-shaped slot passing through the strap in the first end section that separates the first end section into a first connector section and a second connector section. The first connector section and the second connector section can, for example, be deformed to extend in different directions away from one another. A portion of the intermediate portion of the strap can, for example, be coiled in a spiral fashion inside a remainder of the intermediate portion of the strap. The first connector section and the second connector section can, for example, extend in approximately the same plane which passes through or in the vicinity of a center of the coiled intermediate portion. The first connector section can, for example, include a first connector (for example, including a passage). Likewise, the second connector section can, for example, include a second connector (for example, including a passage).

The intermediate section can, for example, include a first path of relatively reduced strength beginning at a first end of the U-shaped slot and a second path of relatively reduced strength beginning at a second end of the U-shaped slot so that tearing occurs along the first path and the second path upon deformation of the energy absorber.

The band can, for example, include a length of material that is held in the form of the band via at least one connector that breaks upon the tensile force of a threshold magnitude being reached.

In a number of embodiments, the first connector comprises a first clevis assembly and the second connector comprises a second clevis assembly.

In another aspect, an energy absorber system includes an actuator including band of material and an energy absorber. A tensile force of a threshold magnitude is required to open the band. Upon opening of the band, the energy absorber is free to deform under tensile force to absorb energy.

The energy absorber can, for example, include a metal strap including a first end section, a second end section, and an intermediate section between the first end section and the second end section. The strap can, for example, include a generally U-shaped slot passing through the strap in the first end section that separates the first end into a first connector section and a second connector section. The first connector section and the second connector section can, for example, be deformed to extend in different directions away from one another. A portion of the intermediate portion of the strap can be coiled in a spiral fashion inside a remainder of the intermediate portion of the strap. The first connector section can, for example, include a first connector (for example, including a passage). Likewise, the second connector section can, for example, include a second connector (for example, including a passage).

In a further aspect, a horizontal lifeline system includes at least one post system, including an extending post member, a first end member in operative connection with a first end of the extending post member, a second end member in operative connection with a second end of the extending post member, a first connector in operative connection with the first end member to connect a lifeline system to the first connector, a second connector in operative connection with the second end member to connect the second end member to a structure; at least one energy absorber system in operative connection between the first end member and the second end member, and a line attached to the post system.

The energy absorber system includes an actuator including a band of material and an energy absorber. The band of material is in operative connection with the first connector and the second connector. A tensile force of a threshold magnitude is required between the first end member and the second end member to open the band. Upon opening of the band, the extending post member is able to tilt relative to the second end member and the energy absorber is free to deform under tensile force to absorb energy.

The technology described herein, along with the attributes and attendant advantages thereof, will best be appreciated and understood in view of the following detailed description taken in conjunction with the accompanying drawings.

BRIEF DESCRIPTION OF THE DRAWINGS

FIG. 1A illustrates a side view of an embodiment of an energy absorber.

FIG. 1B illustrates a top plan view of the energy absorber of FIG. 1A.

FIG. 1C illustrates a side view of the energy absorber of FIG. 1A after deformation to absorb energy and corresponding lengthening.

FIG. 2A illustrates a side view of another embodiment of an energy absorber suitable for use in the energy absorber systems hereof.

FIG. 2B illustrates a perspective view of the energy absorber of FIG. 2A.

FIG. 3A illustrates a disassembled or exploded view of an embodiment of an extending anchorage system of a post system including the energy absorber of FIG. 2A as a component of an energy absorbing system including an actuator in the form of a band or loop of material.

FIG. 3B illustrates a perspective view of the post system of FIG. 3A in an assembled state.

FIG. 12B illustrates an exploded or disassembled side view of the post system of FIG. 11A.

FIG. 12C illustrates an exploded or disassembled front view of the post system of FIG. 11A.

DETAILED DESCRIPTION

Figures 2C, 2D:
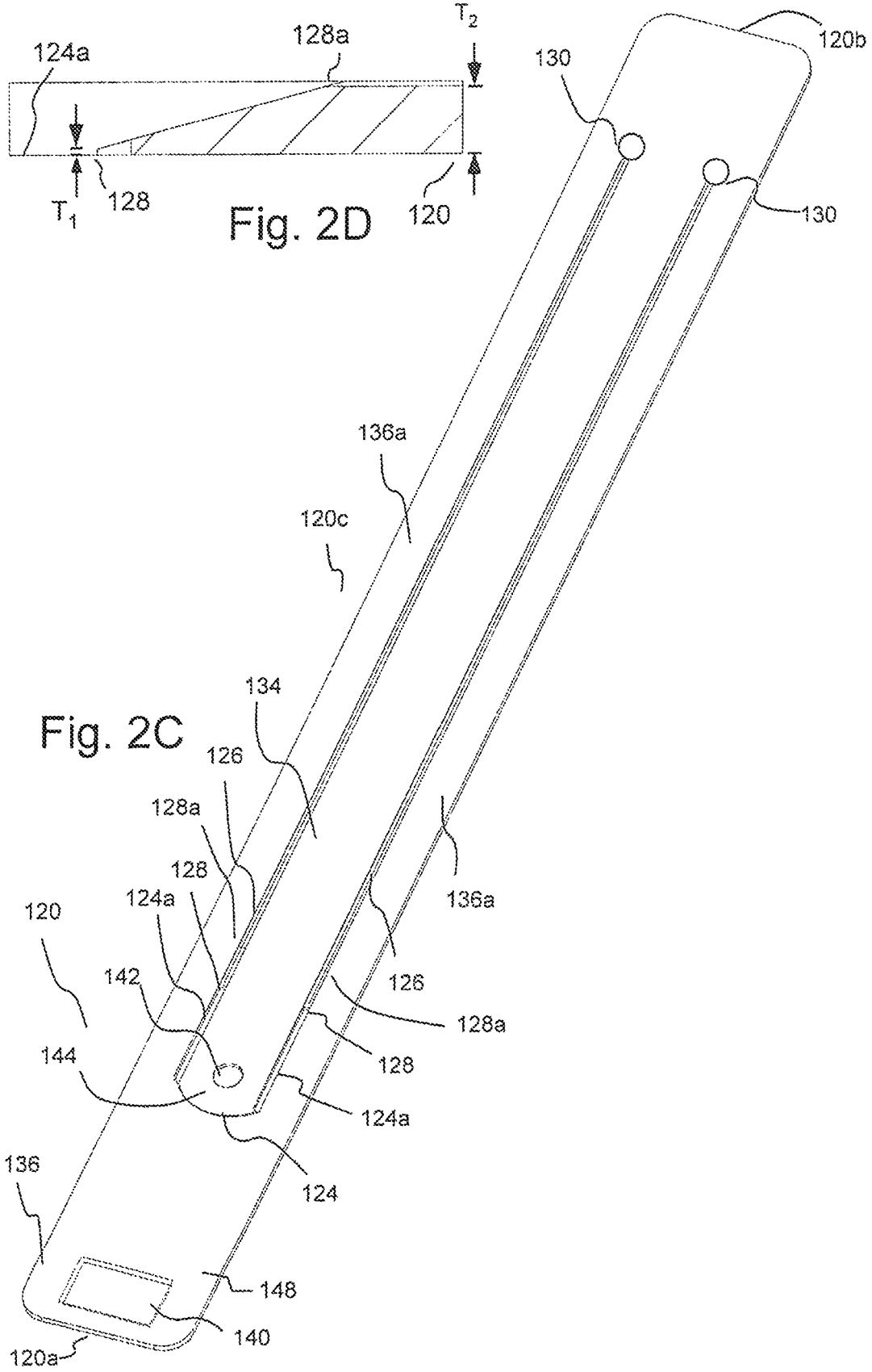
FIG. 2C illustrates a strap of material from which the energy absorber of FIG. 2A is formed.
FIG. 2D illustrates a transition region formed in the strap of material.

As used herein and in the appended claims, the singular forms "a," "an", and "the" include plural references unless the content clearly dictates otherwise. Thus, for example, reference to "connector" includes a plurality of such connectors and equivalents thereof known to those skilled in the art, and so forth, and reference to "the connector" is a reference to one or more such connectors and equivalents thereof known to those skilled in the art, and so forth.

Several representative embodiments of energy or shock absorber systems are discussed herein in connection with use thereof in a fall protection systems such as in connection with an extending anchorage member or system (sometimes referred to herein as a post or post system), which is attached to and extends above a structure such as a roof. Such extending anchorage members or posts can be used individually as an independent anchorage point or collectively as a component of, for example, a horizontal lifeline systems. However, one skilled in the art appreciates that the energy absorber systems described herein can be used in a wide variety of systems in which energy absorption is required to, for example, protect against damage to a structure or to equipment and/or to protect against injury to individuals. In several embodiments, the energy absorber systems described herein are, for example, particularly useful in situations in which energy absorption is to begin only after a threshold force is experienced by the energy absorber. In several representative embodiments, the energy absorber systems hereof are incorporated within energy absorbing post systems for use in fall protection.

Terms such as "left", "right", "rearward", "forward", "upper", "lower" and like terms are used herein to describe the relative position of elements of devices and systems of the present invention with reference to the orientation of the systems set forth in the accompanying drawings.

Although many types of energy absorbers can be used in the energy absorbing systems hereof, in several embodiments, energy absorber systems hereof include an energy absorber having a strap in which a portion of the strap is coiled or rolled over itself. The coiled portion of energy absorber is deformed and/or torn to absorb energy when one section of the strap is pulled to move in a first direction and a second section of the strap is pulled to move in a second direction.

Such an energy absorber is, for example, disclosed in US Published Patent Application No. 2009/1094366, assigned to the assignee of the present application, the disclosure of which is incorporated herein by reference. FIGS. 1A through 1C illustrates such an energy absorber 10, which includes opposing connector ends 12 and 14 having end connectors in the form of passages 12' and 14', and a coiled intermediate section 20. Upon application of a tensile force to ends 12 and 14, energy is absorbed via uncoiling/deformation and/or tearing in coiled section 20 as ends 12 and 14 are pulled away from each other, lengthening energy absorber 10 (see FIG. 1C). Although energy absorber 10 can be used in energy absorbing systems hereof, it can be advantageous in certain situations to use an energy absorber having a reduced profile as compared to the profile (see, for example, FIG. 1B) of energy absorber 10.

FIGS. 2A through 2E illustrate an energy absorber 110 for use in an energy absorbing system 200 as, for example, illustrated in FIG. 3. Unlike energy absorber 10, the end portions of energy absorber 110 extend from the center of or near the center of the coiled portion thereof to, for example, lie in a common plane P. This conformation can provide for a reduced profile as compared to energy absorber 10 while providing similar energy absorption and extension. The reduced profile of energy absorber 110 can, for example, enable a corresponding reduction in the diameter of a post member 210 of post system 200 described below, within which energy absorber 110 is placed.

Energy absorber 110 can, for example, be formed from a strap 120 (for example, a metal strap) as illustrated in FIG. 2C. In one embodiment, the strap was fabricated from stainless steel and was approximately 25.84 inches (approximately 0.6563 meters) long, 2.75 inches (approximately 0.0699 meters) wide, and 0.14 inches (approximately 0.0036 meters) thick. Strap 120 extends lengthwise between a first end or end section 120*a* and a second end or end section 120*b*. In the illustrated embodiment, strap 120 includes a generally U-shaped slot 124 including longitudinally and generally parallel extending sections 124*a*. Slot 124 passes completely through strap 120. At a first end of extending sections 124*a*, slots 124 forms an arcuate path between extending sections 124*a*. Strap 120 also includes two generally parallel, longitudinally extending paths or lines of reduced strength (that is, of reduced strength compared to portions of strap 120 not on the path or line) in the form of two grooves or notches 126 which, in the illustrated embodiment, are formed in the upper side of strap 120 along an intermediate section 120*c* of strap 120. Grooves 126, which can for example be V-shaped grooves, are generally collinear with the extending sections 124*a* of slot 124. In the illustrated embodiment, grooves 126, as well as intermediate section 120*c* begin at transition points 128, corresponding to the second ends of extending sections 124*a* and extend to points 130 which are spaced from a second end 120*b* of the strap 120. In several embodiments, end points 130 of groves 126 terminated at a hole or passage 131 formed in strap 120.

Slot 124 and grooves 126 divide strap 120 into a first section 134 and a second section 136. First section 134 divides second section 136 over the length of intermediate section 120*c* into outer or lateral sections or strips 136*a*. A passage 140 extends through first section 134 to, for example, receive a connector. Similarly, a passage 142, positioned generally centrally within the arcuate section of slot 124 extends through second section 136 to receive a second connector.

Grooves 126 can, for example, be of uniform depth, with a step change in the thickness of strap 120 occurring at transition points 128 to that uniform depth. As described in US Published Patent Application No. 2009/1094366, transition regions can be provided at transition points 128 wherein the depth of grooves 126 (or the thickness of strap 120) changes. As illustrated, for example, in FIG. 2D, the strap thickness can change from a thickness $T_1$ to a thickness $T_2$ over a defined (nonzero) distance or transition region between initial transition point 128 (wherein a nonzero thickness first occurs) and transition end points 128*a*. In the illustrated embodiment, the transition in thickness in the transition region between points 128 and 128*a* is a generally linear gradual transition or ramp. In one embodiment of such a ramp, the angle of the transition region was approximately 15°. Load force increases gradually during the dynamic initiation of tearing in the case of a transition region as, for example, illustrated FIG. 2D.

Figure 2E:
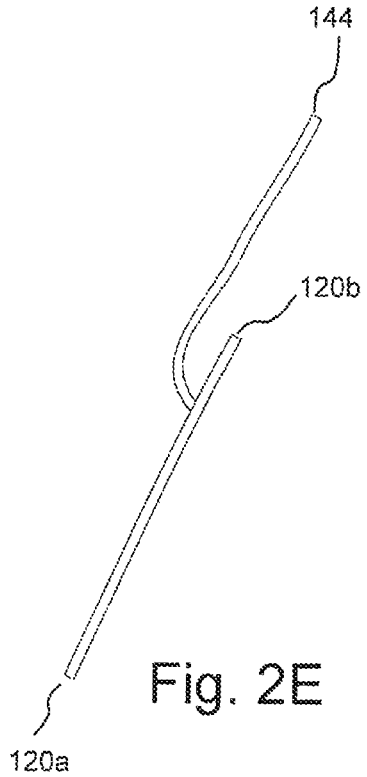
FIG. 2E illustrates a side view of the energy absorber of FIG. 2A after deformation to absorb energy and corresponding lengthening.
Figure 2G:
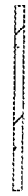
FIG. 2G is a cross-sectional view (section C-C of FIG. 2F) of the strap of material from which the energy absorber of FIG. 2A is formed.
Figure 2F:
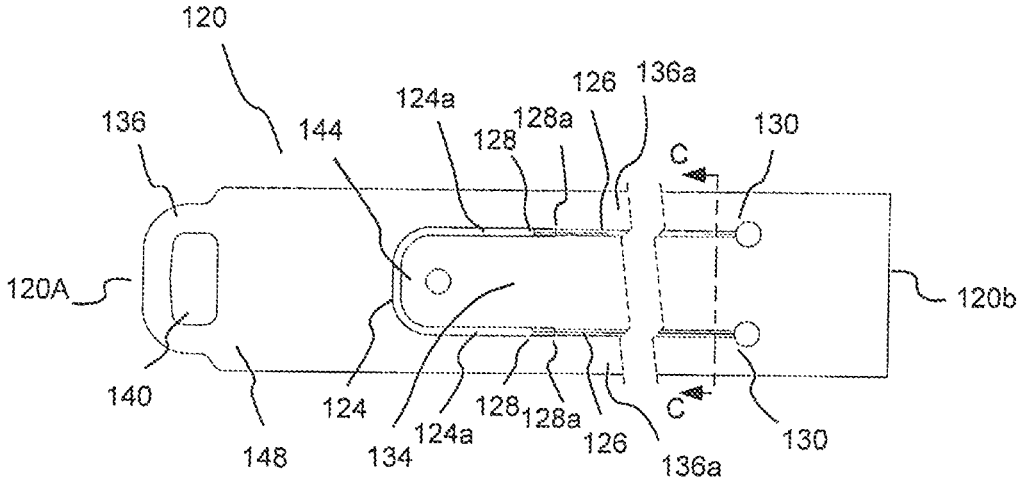
FIG. 2F illustrates a top view of the strap of material from which the energy absorber of FIG. 2A is formed.

Strap 120 is deformed into the configuration illustrated, for example, in FIGS. 2A and 2B. In the coiled configuration of FIGS. 2A and 2B, second end 120*b* of strap 120, intermediate portion 120*c* and a portion of strap 120 between intermediate portion 120*c* and first end 120*a* are rolled or coiled in a generally spiral manner (see, for example, FIG. 2A) to create a coiled section 143. An end portion 144, including passage 142 of first section 134, can be bent to extend in a direction opposite of an end portion 148, which includes passage 140 of second section 136. In the illustrated embodiment, end portion is bent away from intermediate portion 120*c* in, for example, a manner so that end portion 144 extends in approximately the same plane or in the same plane as end portion 148 as described above. As illustrated in FIG. 2B, end portion 144 and end portion 148 can, for example, extend in opposite direction in plane P which bisects or approximately bisects coiled section 143. Energy absorber 110 can then be connected in series between two other members via passages or holes 140 and 142. Coiling energy absorber 110 results in a compact volume while providing significant energy absorption. In that regard, energy is absorbed both by tearing of strap 120 along the path defined by grooves 126 and by uncoiling of coiled section 142. A spent (uncoiled and torn) strap 20 is illustrated in FIG. 2E.

Figure 4A:
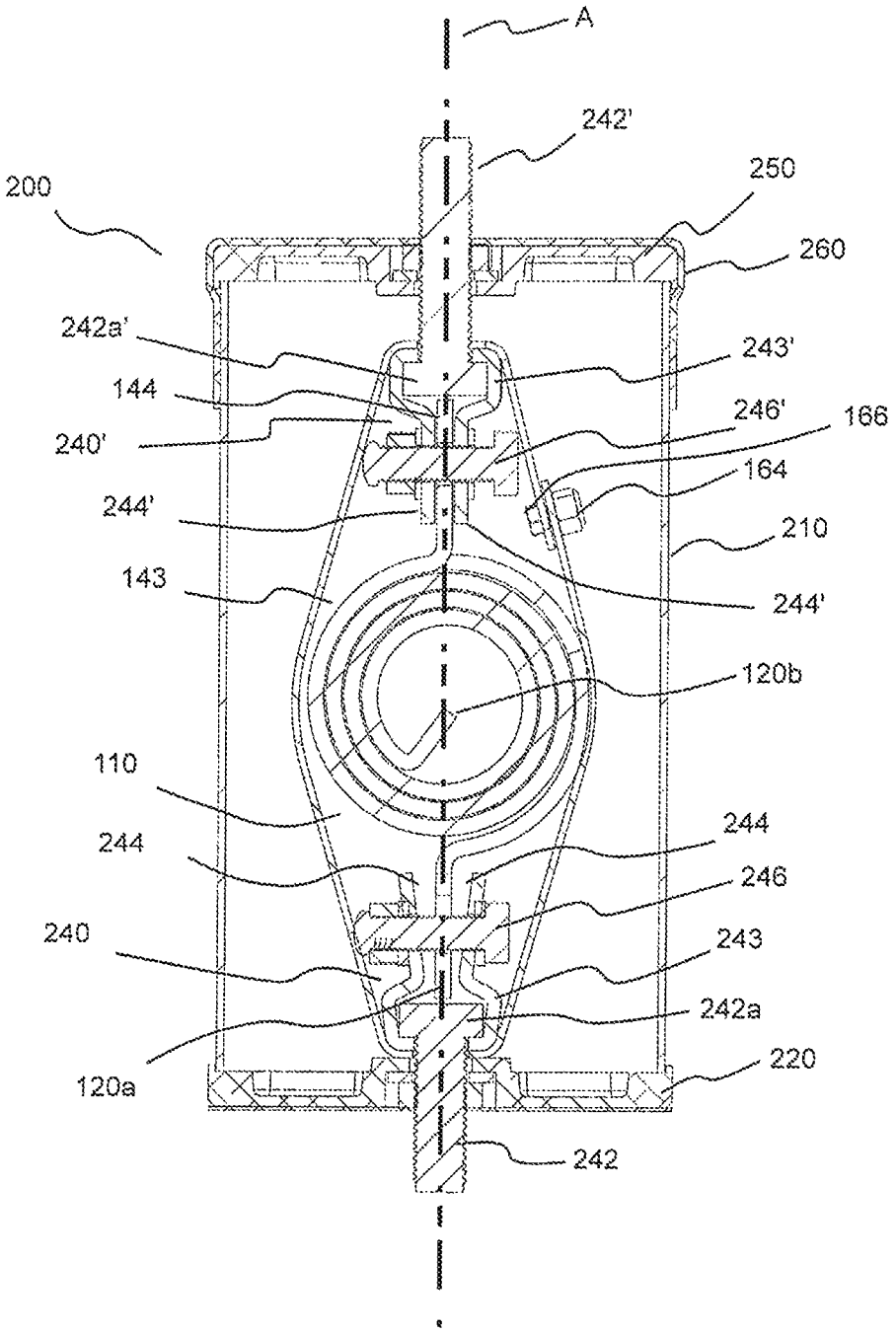
FIG. 4A illustrates a side cross-sectional view of the post system of FIG. 3A in an assembled state.
Figure 4B:
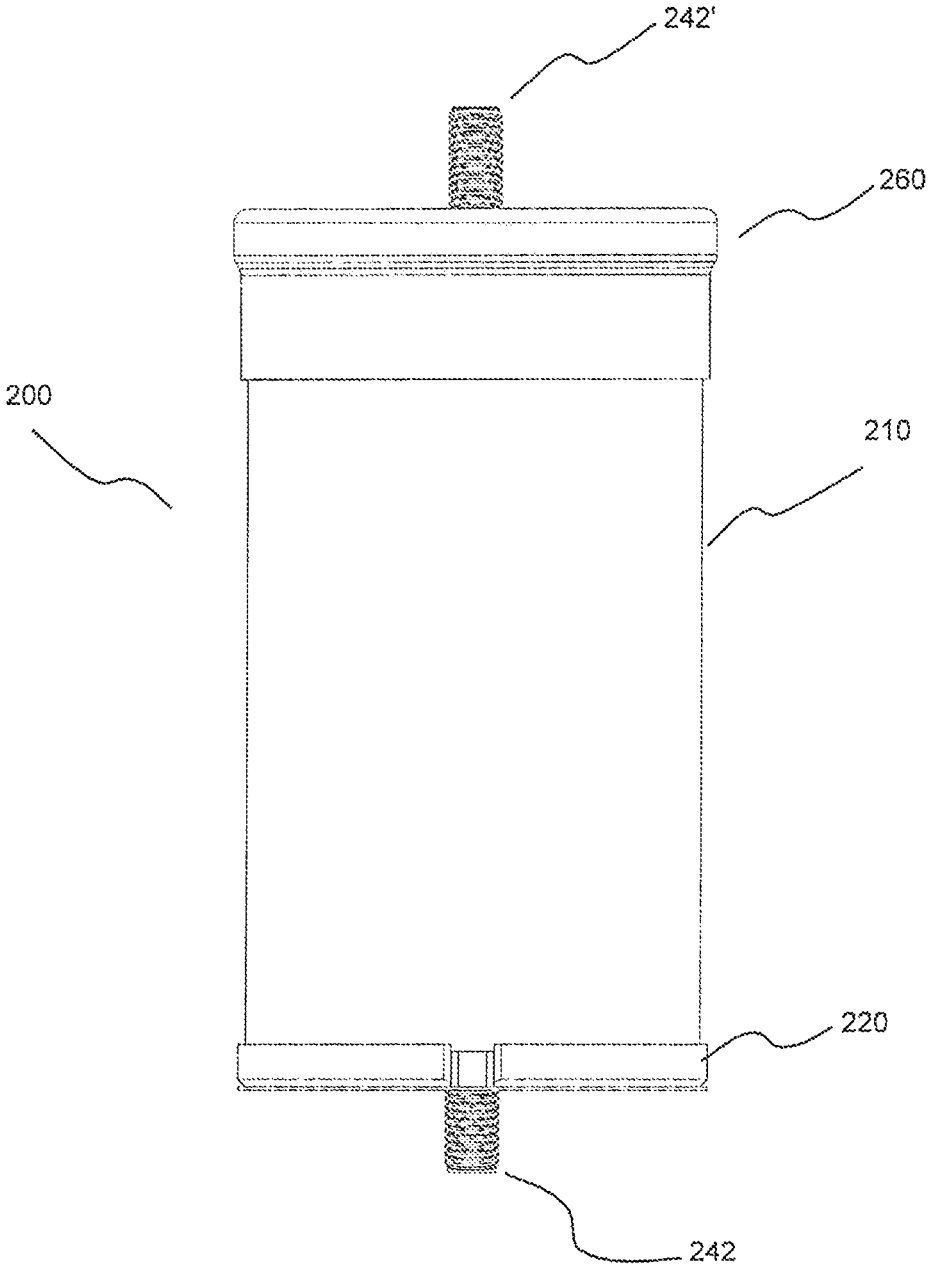
FIG. 4B illustrates a side view of the post system of FIG. 3A in an assembled state.
Figure 5A:
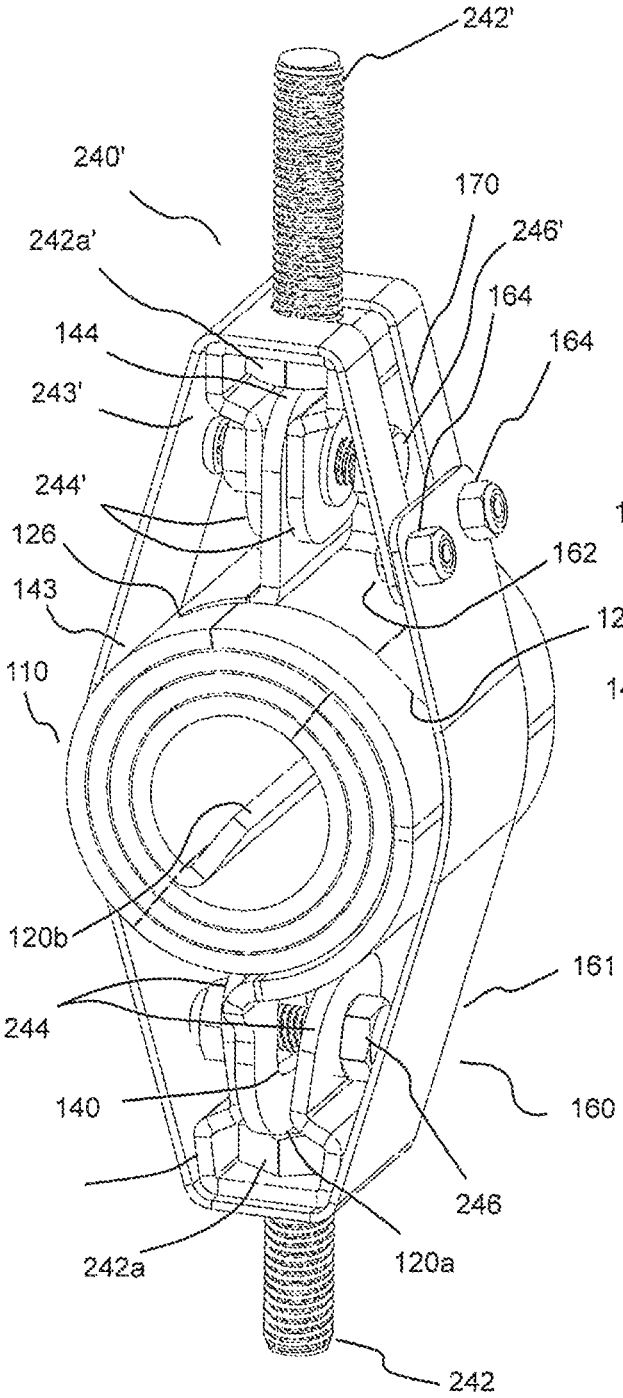
FIG. 5A illustrates a perspective view of the energy absorber system of the post system of FIG. 3A.
Figure 5B:
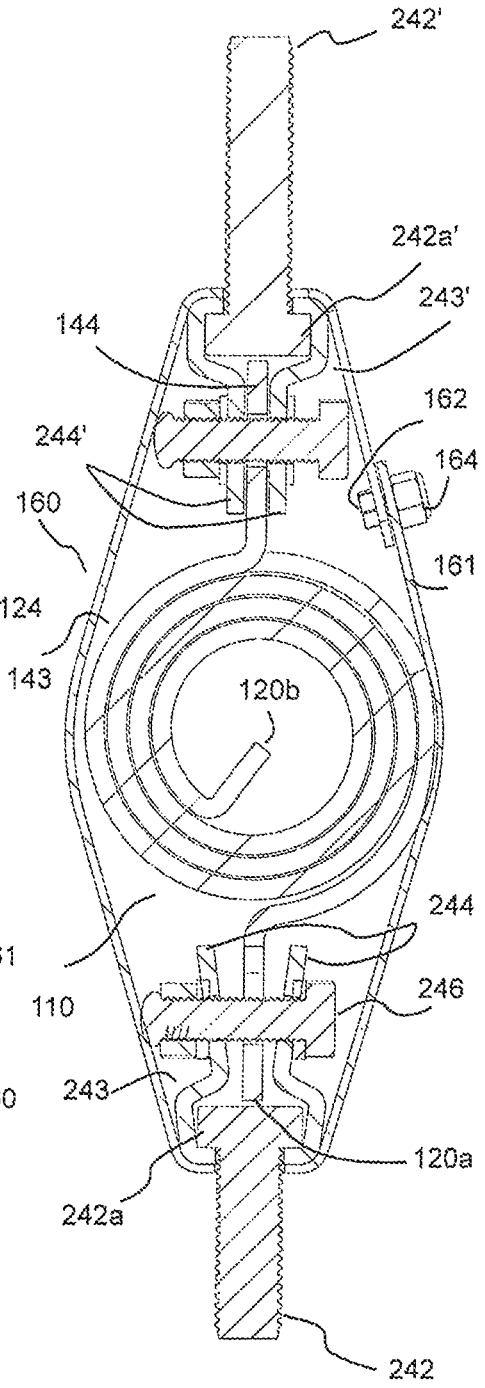
FIG. 5B illustrates a cross-sectional view of the energy absorber system of the post system of FIG. 3A.
Figure 5C:
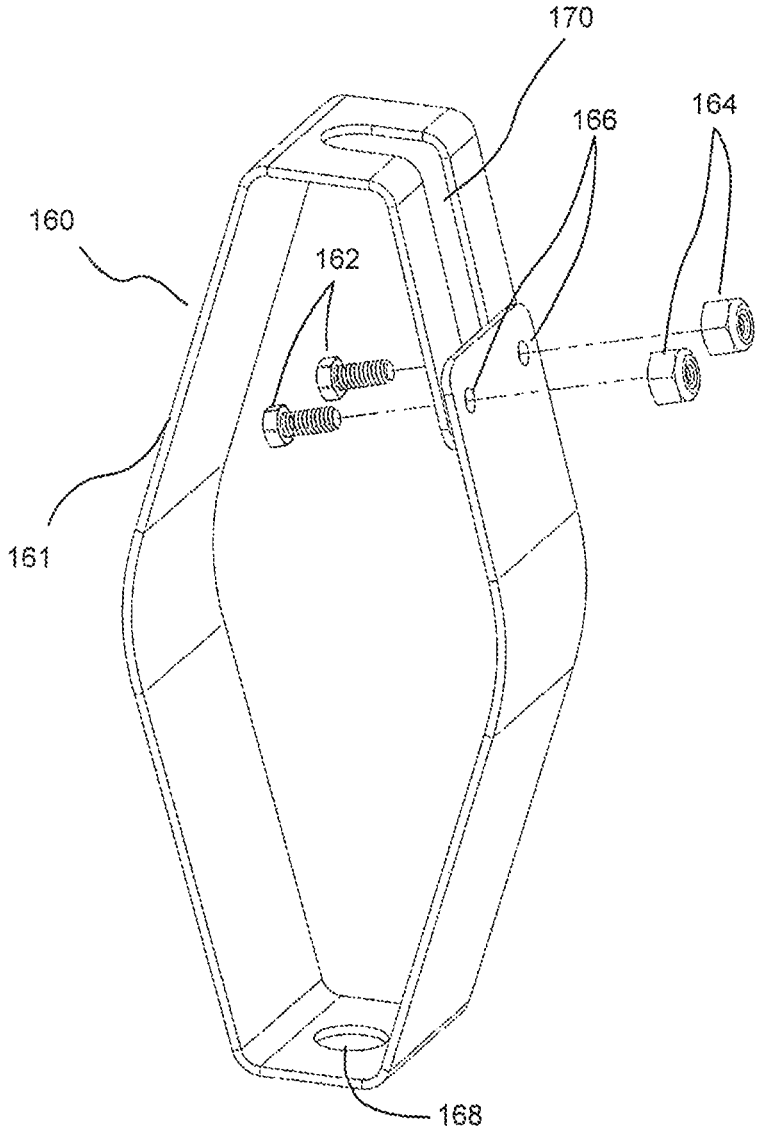
FIG. 5C illustrates a top view of strap of material from which the actuating band of the energy absorber system is formed.
Figure 5D:
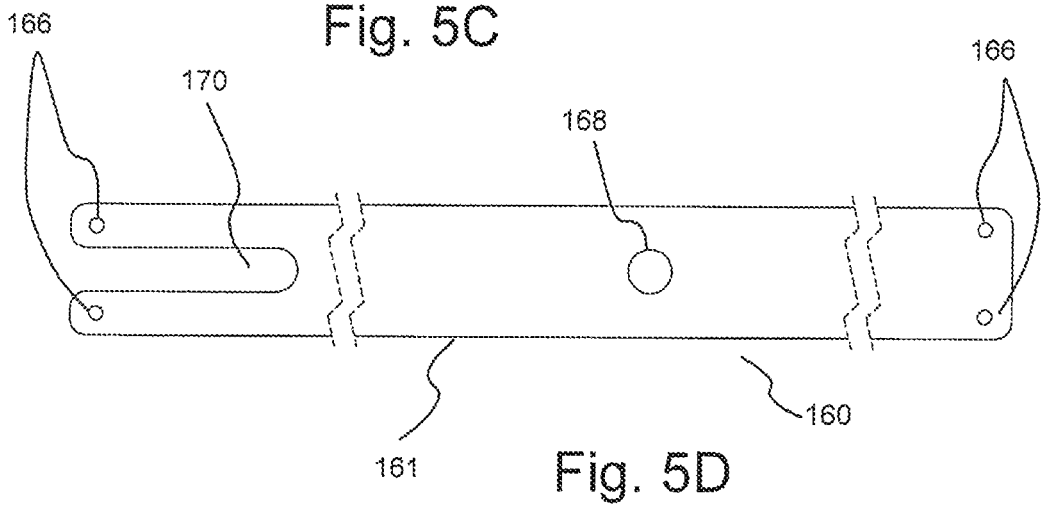
FIG. 5D illustrates a perspective view of the actuating band of the energy absorber system.

In a number of representative embodiments, energy absorber 110 was incorporated into in an extending anchorage or post system 200 as illustrated, for example, in FIGS. 3 and 4. When incorporated into post system 200 (or other systems), energy absorber 110 can, for example, be a component of an energy absorbing system 100 which further includes an actuating mechanism so that deformation of energy absorber 110 can begin only after a threshold force is experienced by energy absorber system 100. As for example, illustrated in FIG. 5A, the actuating mechanism or actuator can, for example, include a band or loop 160 that encompasses and is operatively connected to energy absorber system 110. Band or loop 160 can, for example, be formed from a strap 161 of metal that is bent in the form illustrated, for example, in FIGS. 5A and 5B, and connected together via connectors such as bolts or shear pins 162 and cooperating nuts 164, which pass through overlapping passages 166 formed in the vicinity of each end strap 161. Other method of connection to form a band or loop (for example, welding, interconnection etc.) are suitable to provide a threshold opening force. In the illustrated embodiment, strap 161 includes a passage 168 and an extending slot 170 via which strap 161 is respectively placed in operative connection with a first connector system that is placed in operative connection with passage 140 of connector 110 and a second connector system that is placed in operative connection with passage 142 of connector 110.

Figure 6:
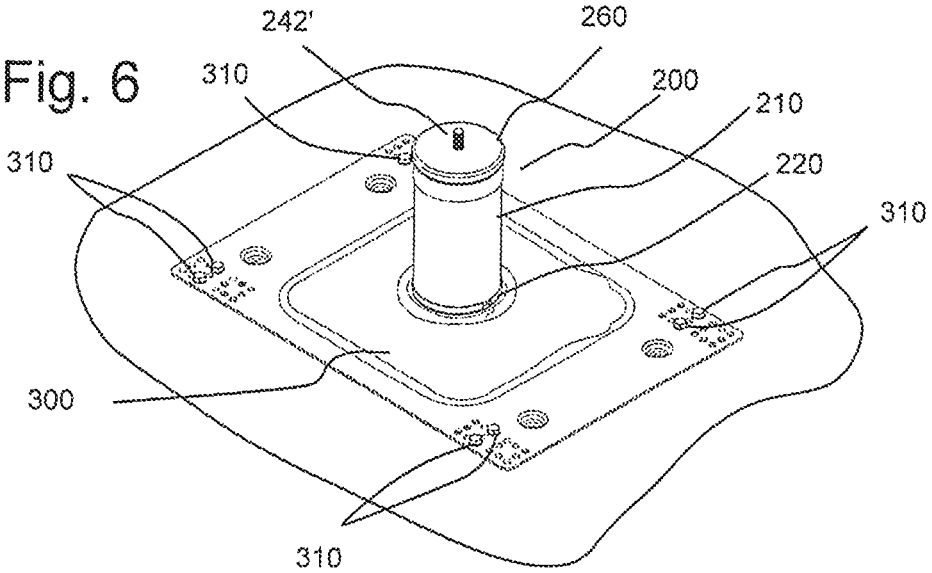
FIG. 6 illustrates the post system of FIG. 3A attached to a structure via a base.

Post system 200 includes a generally cylindrical extending member or post member 210. A bottom of post member 210 can, for example, be seated upon an end member 220 and an elastomeric seal member (not shown) which can, for example, be positioned below end member 220. Each of end member 220 and the seal member can, for example, include a generally central passage (passage 222 in the case of end member 220), through which a threaded connector 242 (for example, a bolt) of a first clevis assembly 240 passes to connect to a base 300 (see FIG. 6). Base 300 can be attached to a structure via, for example, connectors such as bolts 310. Bolts 310 can cooperate directly with the structure or with intermediate connectors such as clamp members for attachment to the structure (for example, a roof).

First clevis assembly 240 includes a connector 243 including a pair of extending connective members 244, each of which includes a passage 244*a* therethrough. Connector 243 can, for example, be retained on threaded connector 242 via an upper flange 242*a* (for example, a bolt head). First end 120*a* of energy absorber 110 can, for example, pass between extending connective members 244 so that a connector such as a bolt 246 can be passed through passages 244*a* and passage 140 to connect energy absorber 110 to clevis assembly 240. In the illustrated embodiment, extending connective members 244 are splayed open or bent away from each other to facilitate tipping as described further below.

Post system 200 further includes an upper end member 250 which rests upon an upper end of post member 210. An upper cap member 260 extends over upper end member 250 and a portion of post member 210. Each of upper end member 250 and upper cap member 260 includes a generally central passage 252 and 262, respectively, through which a threaded connector 242' (for example, a bolt) of a second clevis assembly 240' to, for example, connect to a lifeline connector 400 (see, for example, FIG. 7). Second clevis assembly 240' is identical to first clevis assembly 240 in many respects and like elements are numbered similarly to corresponding elements of first clevis assembly 240 with the addition of the designation thereto. End portion 144 of energy absorber 110 passes between extending connective members 244' so that a connector such as a bolt 246' can be passed through passages 244*a*' and passage 242 to connect energy absorber 110 to second clevis assembly 240'. In the illustrated embodiment, unlike extending connective members 244 of first clevis assembly 240, extending connective members 244' are not splayed or bent away from each other. Band 160 extends around and abuts connector 243 and connector 243' to prevent relative motion thereof (and thus prevent actuation of energy absorber 110) until band 160 opens upon experiencing a threshold tensile force (applied via connectors 243 and 243' of clevis assemblies 240 and 240', respectively).

Because energy absorber 110 will not actuate until the threshold tensile force is experienced by actuator or band 160 of energy absorber system 100, post system 200 can, for example, be pre-tensioned during attachment of post system 200 to base 300 to ensure secure attachment and suitable operation. The threshold force can, for example, be selected using known engineering principles to ensure suitable pre-tensioning. Moreover, the threshold force can be chosen such that energy absorber 110 is not actuated during normal use (that is, that energy absorber 110 is actuated only in the case of a fall).

As, for example, illustrated in FIG. 4, in a number of embodiments, a center axis A of post system 200 coincides generally with plane P of energy absorber 110 and with a centerline of actuator or band 160. A force applied to lifeline connector 400 (see, for example, FIG. 7) from any direction is transferred through axis A and through band 160. The amplitude of the force is generally independent of the direction of the force. Once a threshold force is reached, shear pins 162 break or shear and band 160 opens. At this point, energy absorber 110 is engaged and begins to extend, allowing post member 210 to tilt relative to base 300.

Figure 8A:
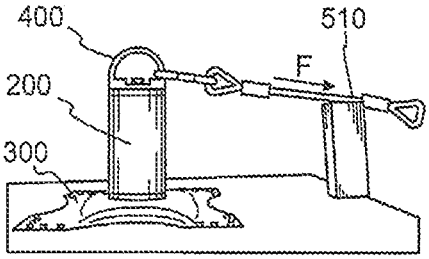
FIG. 8A illustrates the post system of FIG. 3A just prior to experiencing a threshold load represented by arrow F associated with a fall.
Figure 8B:
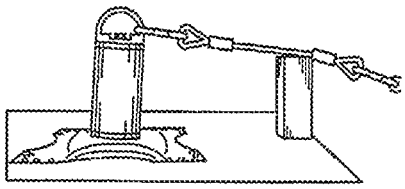
FIG. 8B illustrates the post system shortly after experiencing a threshold force F, which has caused connectors the band of the energy absorbing system to open, whereby the energy absorber is actuated and lengthens to allow the upper portion of the post system to tilt or tip relative to the lower portion of post system
Figure 8C:
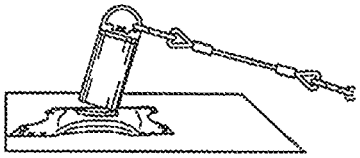
FIG. 8C illustrates a perspective view of the post system during the tilting or tipping process.
Figure 8D:
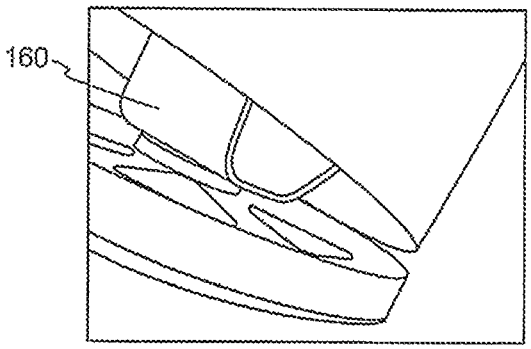
FIG. 8D illustrates another perspective view of the post system during the tilting or tipping process.
Figure 8E:
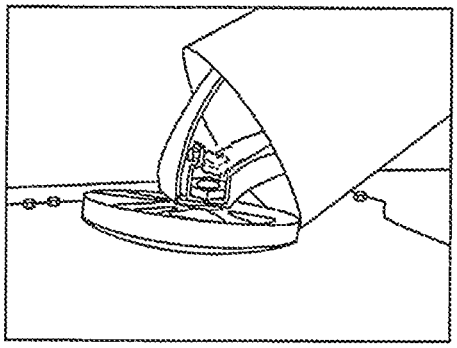
FIG. 8E illustrates another perspective view of the post system during the tilting or tipping process.
Figure 8F:
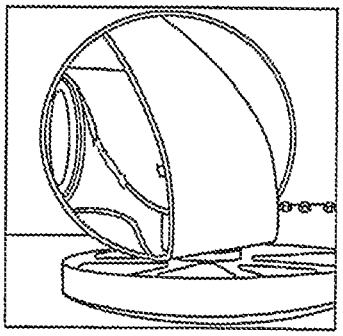
FIG. 8F illustrates the post system after the post member thereof has completely tilted relative to the lower portion of the post system.
Figure 8G:
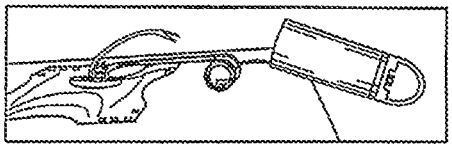
FIG. 8G illustrates the energy absorber extended to approximately it's full extended state, after lengthening to absorb energy.

FIG. 8A through 8G illustrates the tipping of post system 200 and the extension of energy absorber 110 to adsorb energy. FIG. 8A illustrates post 200 just prior to experiencing a threshold load represented by arrow F associated with a fall. In FIG. 8B, post system 200 has experienced threshold force F, which has caused connectors or shear pins 162 band 160 to be sheared. The lengthening of energy absorber 110 allows the upper portion of post system 200 to tilt or tip relative to the lower portion of post system 200 (that is, relative to end member 220, which is attached to base 300). FIGS. 8C through 8F illustrates post system 200 during the tilting or tipping process. In FIG. 8F, post member 210 has completely tilted relative to lower member 220 to a horizontal orientation. In FIG. 8G, energy absorber 110 has extended to approximately it's full extended state, absorbing energy during such extension. As described above, the tipping or tilting of the upper section of post system 200 relative to end member 220 and the structure to which end member 220 is attached reduces the torque experienced by the structure to which post system 200 is attached, assisting in preventing damage to the structure.

Figure 7:
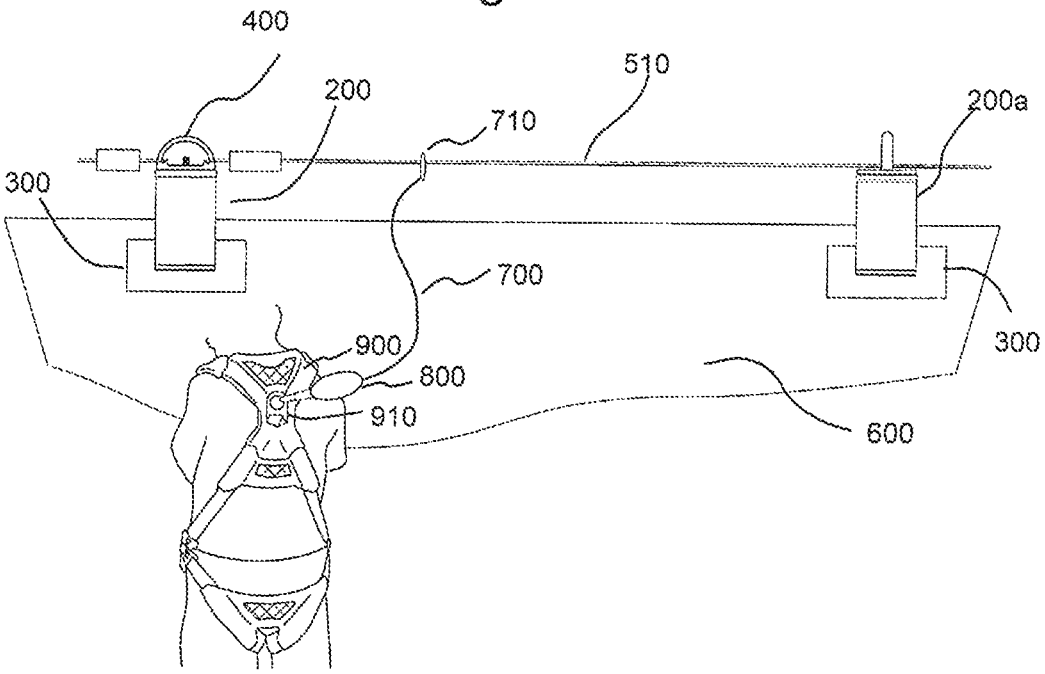
FIG. 7 illustrates a side view of an embodiment of a horizontal lifeline system including a post system of FIG. 3A.

FIG. 7 illustrates the use of post system 200 as end post in a horizontal lifeline system 500, which includes a generally horizontally extending lifeline 510. A portion of horizontal lifeline system 500 is illustrated in FIG. 7 and includes an intermediate post system 200*a* as, for example, described in U.S. Provisional Patent Application Ser. No. 61/372,643, assigned to the assignee of the present invention, filed Aug. 11, 2010. Each of end post system 200 and intermediate post system 200*a* are attached to a roof structure 600 via base 300. A user is illustrated connected to horizontal lifeline 510 via a lifeline 700 including a connector 710 at a distal end for connection to horizontal lifeline 510. A proximal end of lifeline 700 can, for example, be connected to a self-retracting lifeline system 800 as known in the fall protection arts. Self-retracting lifeline system 800 is connected to a connector such as a D-ring 910 of a safety harness 900 worn by the user.

Figure 9:
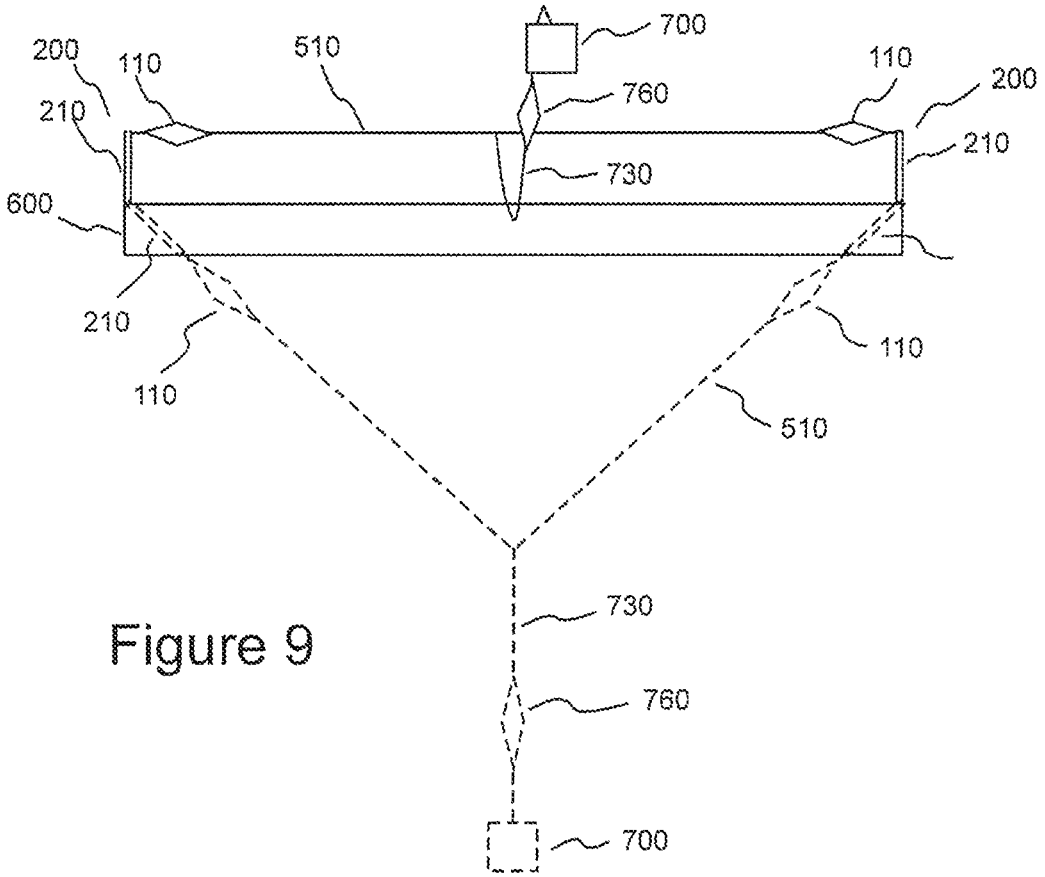
FIG. 9 illustrates schematically the increase in effective line length of a lifeline in operative connection with a tipping post system.

Tipping of a post member such as post member 210 can result in an increase in the vertical fall of a user by increasing the effective length of line 510. Depending upon the length of post member 210, the increase in effective line length can, for example, be in the range of approximately 7 to approximately 10 inches (approximately 0.178 meters to approximately 0.254 meters). For lifeline systems with post members at each end, the increase in effective line length doubles. The force transferred to the anchorage and thereby to structure is caused directly by the tension of lifeline 510. At low line angles (with respect to the horizontal), the force arising from a fall of user 700 generates a significant multiplication of the force in lifeline 510. Therefore, to protect the anchorage and structure 600, it is desirable to rapidly increase the effective length of lifeline 510 when a fall occurs. However, as set forth above, the increase in the effective length of lifeline 510 result in an increase in the vertical fall of user 700. FIG. 9 illustrates schematically (and in dashed lines) the effective increase in the length of lifeline 510 upon tipping of end posts 210 of post systems 200 and activation/extension of energy absorbers 110 thereof. User 700 is illustrated connected to line 510 via a personal lifeline or lanyard 730 and a personal energy absorber 760 (for example, a self-retracting lifeline system). In the case of a fall, personal energy absorber 760 also extends to absorb energy, increasing the effective length of personal lifeline 760. The effective increase in the length of lifeline 510 and the increase in the effective length of personal lifeline 760 must be considered in ensure that sufficient fall clearance is provided.

In the case of connection of a second and additions users to lifeline 510, further considerations are important. In that regard, user 700 may fall, causing deflection and increased effective length in lifeline 510 as illustrated in FIG. 9. As user 700 falls, if the line deflection is great enough, it will cause the second user (not shown) to fall. However, the second user's free fall distance has increased (compared to user 700) by the distance lifeline 510 has deflected from its original position. In addition to the danger of being pulled by the moving line, the second user will fall farther, imposing more potential and kinetic energy into the system, causing the connection point to the lifeline 510 to deflect farther. In systems in which more than two users may be present, the above scenario can continue, each time requiring more energy to be absorbed.

Figure 10A:
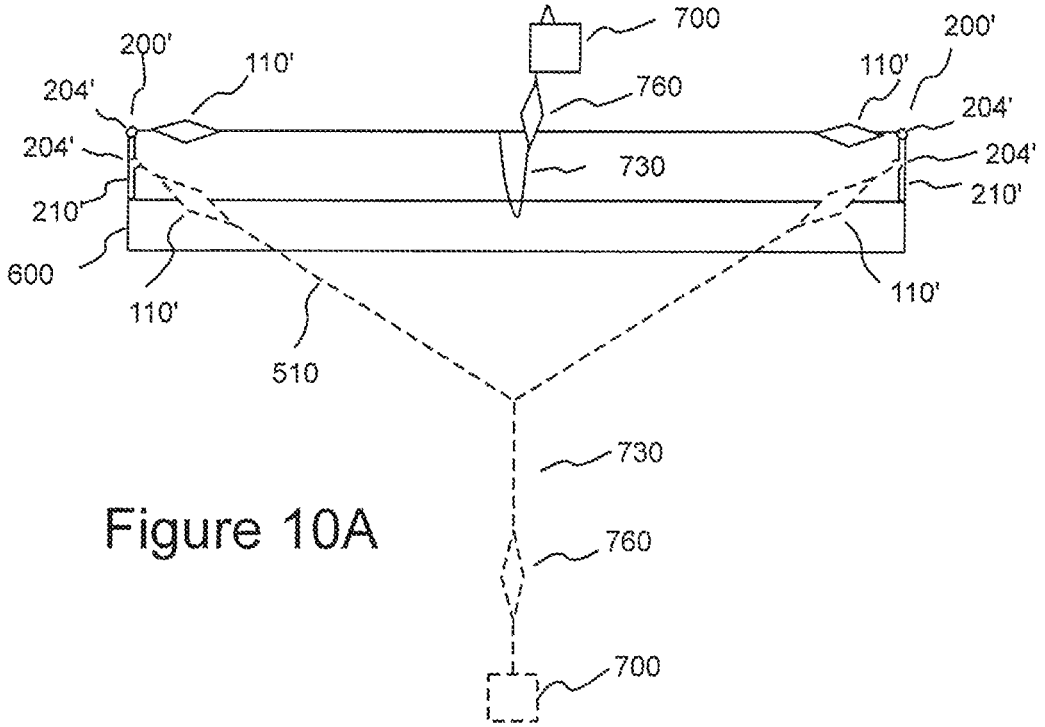
FIG. 10A illustrates schematically the increase in effective line length of a lifeline in operative connection with another embodiment of a post system hereof including a support operable to maintain a lifeline at a first height until a first threshold force is experienced on the lifeline, whereupon the support is operable to lower the lifeline to a second height which is lower than the first height.

In certain situations, it may thus be desirable to limit the increase in effective line length and thereby the potential vertical fall of one or more users. FIG. 10A illustrates a schematic representation of a horizontal lifeline system including end post systems 200' hereof wherein post systems 200' include a support 204' connected to the extending post member 210' and in operative connection with a lifeline 510. Support 204' maintains lifeline 510 at a first height until a first threshold force is experienced in lifeline 510. Upon experiencing the threshold force, support 204' is actuatable or operable to lower lifeline 510 to a second height which is lower than the first height. In that regard, support 204' includes an actuating mechanism, actuating device or actuator adapted to lower lifeline 510 upon experiencing a threshold force in lifeline 510. The increase in the effective length of lifeline 510 associated with actuation of support 204' is significantly less than that associated with systems including tipping post systems. Nonetheless, the lowering of lifeline 510 by support 204' sufficiently reduces torque to reduce, minimize or prevent damage to the roof or other structure to which post systems 200' are attached.

Activation/extension of energy absorbers 110' of the embodiment of FIG. 10A also increases the effective length of lifeline 510. Energy absorbers 110' can, for example, be a component of post system 200 and/or be placed in line with lifeline 510.

Figure 10B:
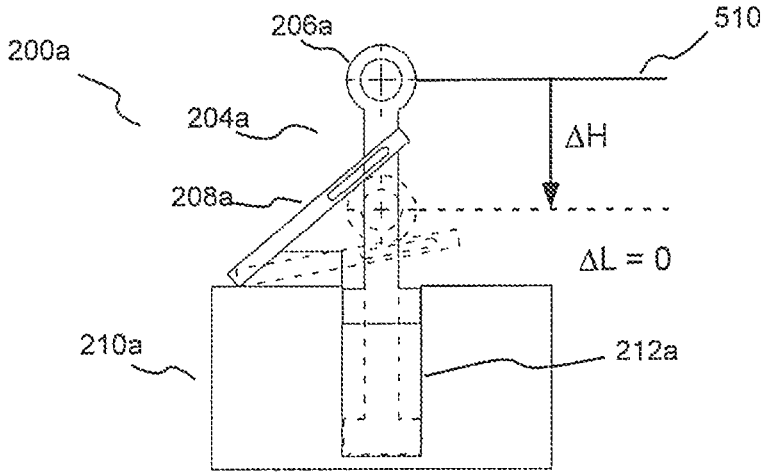
FIG. 10B illustrates schematically an embodiment of a post system including a support which maintains a lifeline at a first height until the threshold force is experienced and the lifeline is lowered to a second lower height (see broken lines), wherein no change in effective length of the lifeline is associated with the change in height upon experiencing the threshold force.
Figure 10C:
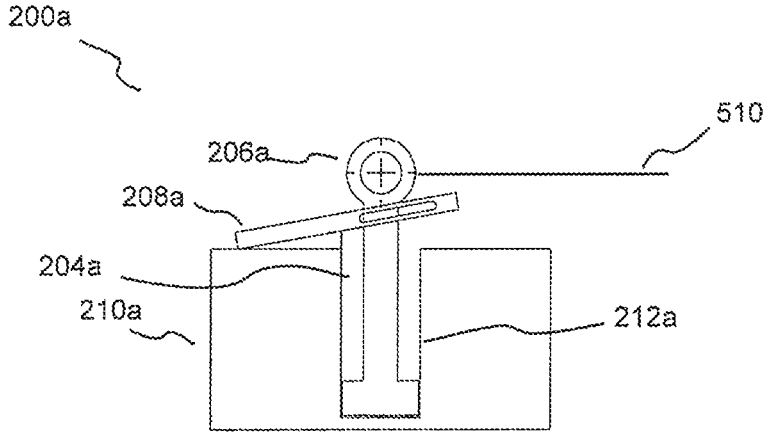
FIG. 10C illustrates the post system of FIG. 10B after experiencing the threshold force to lower the lifeline to a second lower height.

Many different mechanisms, systems and/or methods of actuating a support system to effect lowering of the height of the lifeline upon experiencing a threshold force in the lifeline can be used without the significant increase in effective length of the lifeline associated, for example, with tipping of one or more of the post members. In a number of embodiments hereof, the ratio of the associated increase in the effective length (ΔL) to the decrease in the height of lifeline 510 (ΔH) is less than 1.0, less than 0.5 or even less than 0.4. In the case currently available tipping post systems, the ratio ΔL/ΔH is greater than 1.0. FIGS. 10B and 10C illustrate schematically a post system 200*a* including an embodiment of a support 204*a* which maintains lifeline 510 (connected to system 204*a* via a connector 206*a*) at a first height until the threshold force is experienced. Upon experiencing the threshold force, actuator 208*a* of support system 204*a* actuates and causes the height of lifeline 510 to be lowered by a distance ΔH. In the embodiment of FIGS. 10B and 10C, the change in effective length of lifeline 510 (ΔL) is approximately 0. In the illustrated embodiment, connector 208*a* drops downward upon actuation of actuator 206*a* and a portion of support 204*a* passes into a passage or seating 212*a* formed in member 210*a*.

Figure 10D:
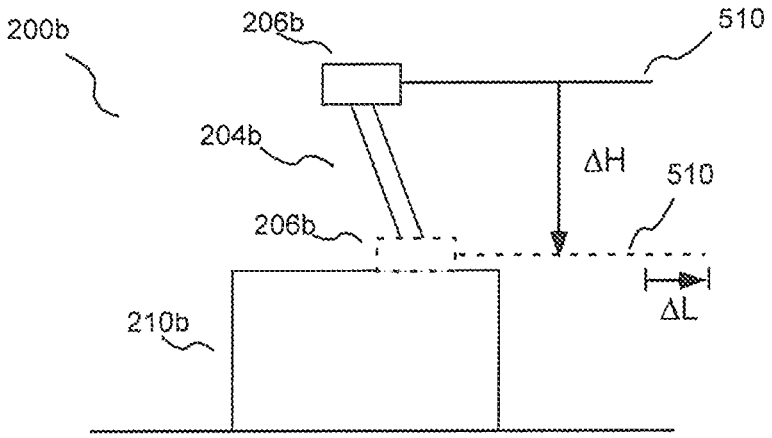
FIG. 10D illustrates schematically another embodiment of a post system including a support which maintains a lifeline at a first height until the threshold force is experienced and the lifeline is lowered to a second lower height (see broken lines), wherein a non-zero change in effective length of the lifeline is associated with the change in height upon experiencing the threshold force.

In a number of embodiments, a support hereof includes an angled or bent member to maintain lifeline 510 (or another lifeline) at a first height. FIG. 10D illustrates an embodiment of a support 204*b* in which a moveable connector 206*b* for lifeline 510 which slides down an angled member a vertical distance corresponding to ΔH upon activation at a threshold force. An increase in effective length of lifeline 510 of ΔL is associated with ΔH.

FIGS. 11A through 13D illustrate another embodiment of a post system 1200 operable in a manner similar to post system 210" which can, for example, be used individually or in a horizontal lifeline system. Post system 1200 raises lifeline 510 attached to a user above elevated structure 600 (see, for example, FIG. 13A). Unlike posts or other supports which are predisposed at an upright or vertical position, and upon experiencing a force above a threshold force, tip or tilt to a near horizontal position to reduce torque and reduce or minimizing damage to roof or other elevated structure 600, post system 1200 predisposes a moveable connector or attachment member to an acute angle, for example 40 degrees from the horizontal, to minimize the increase of line length upon activation.

Post system 1200 includes a generally cylindrical extending member or post member 1210. A bottom of post member 1210 can, for example, be seated upon a first end member or bottom section 1220. An elastomeric seal member 1230 can, for example, be positioned below first end member 1220. Each of first end member 1220 and seal member 1230 can, for example, include a generally central passage 1222 and 1232, respective, through which a threaded connector 1240 (for example, an extending all-thread member or rod) passes to connect post system 1200 to elevated structure 600 (via, for example, a base as described in connection with post system 200). A first connector 1242 (for example, a bolt) connects to threaded connector 1240 between seal member 1230 and end member 1220. In the illustrated embodiment, first end member 1220 includes a seating 1224 in which bolt 1242 is seated. Threaded connector 1240 passes through the interior of post member 1210 and exits a passage 1214 (which can, for example, be a threaded passage) in a top section or second end member 1212.

Post system 1200 also includes a support 1300 operatively connected to second end member 1212. Support 1300 is operable to support the connection point or connection height of line 510 to post system 1200 to a first or raised position until a threshold force is experienced. Upon experiencing the threshold force, at least a portion of support 1300 can, for example, move in a manner that the connection point or height of line 510 to post system 1200 is lowered to a second or lower position. In the illustrated embodiment, support 1300 includes a first or stationary member 1310 which is attached to second end member 1212. In that regard, first member 1310 includes a passage 1312 through which threaded connector 1240 passes to cooperate with a connector 1244 (such as a nut) to connect first member 1310 second or upper end member 1212. A second or movable member 1320 of support 1300 is movably connected to first member 1310 (and thereby movable relative to post member 1210 and to the structure to which post member 1210 is attached) via, for example, one or more connectors. In the illustrated embodiment, second member 1320 is rotatably or pivotably connected to first member 1310 via extending connectors 1332 such as rivets. Extending connectors 1332 pass through passages 1314 and 1324 in first member 1310 and second member 1320, respectively, to pivotably connect second member 1320 to first member 1310 and thereby to post member 1210.

Figure 11C:
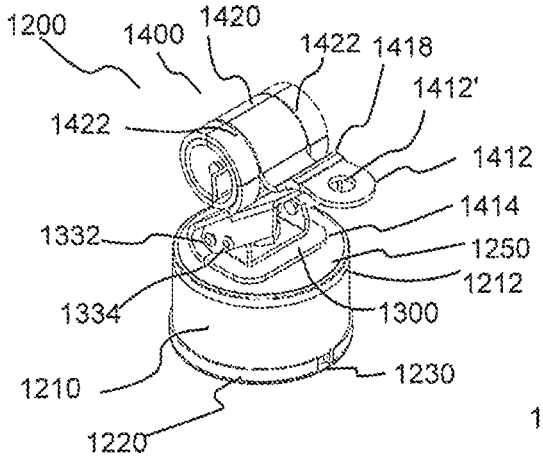
FIG. 11C illustrates a perspective view of the post system of FIG. 11A with the cover thereof removed and the moveable member of the support in the first position.
Figure 11A:
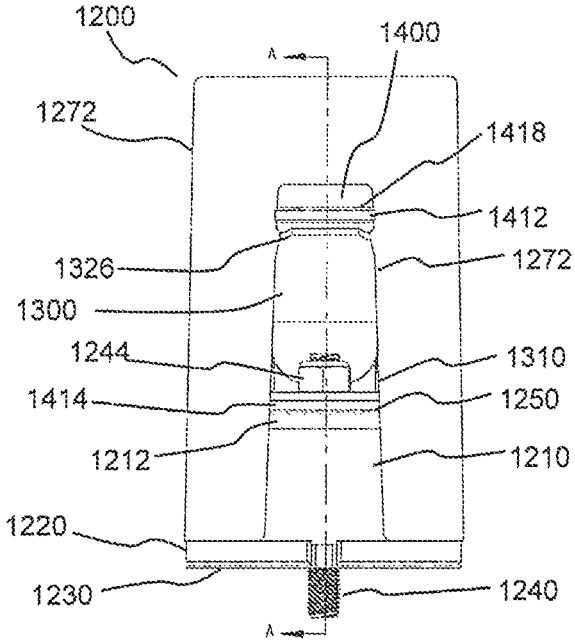
FIG. 11A illustrates a front view of an embodiment of a post system including a support operable to maintain a lifeline at a first height until a first threshold force is experienced on the lifeline, whereupon the support is operable to lower the lifeline to a second height which is lower than the first height.
Figure 11B:
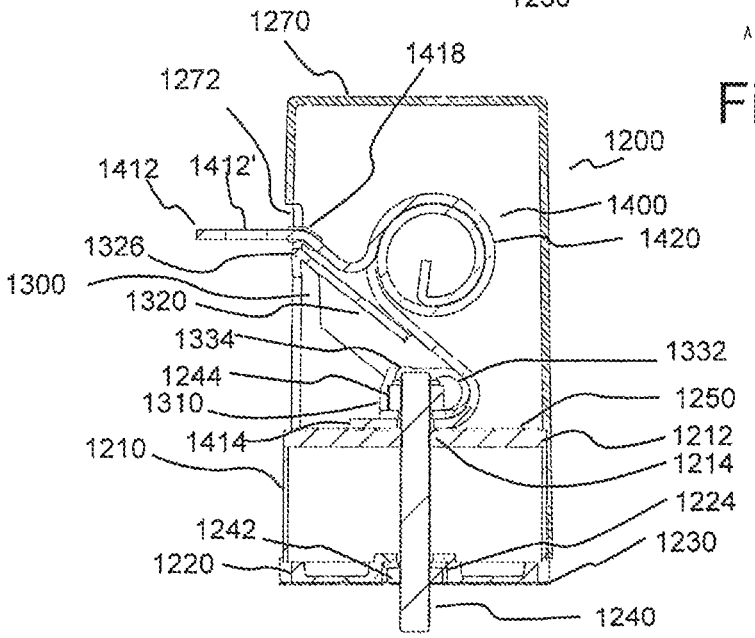
FIG. 11B illustrates a side cross-sectional view of the post system of FIG. 11A wherein a first or moveable member of the support is in a first position to maintain the lifeline at the first height.
Figure 12A:
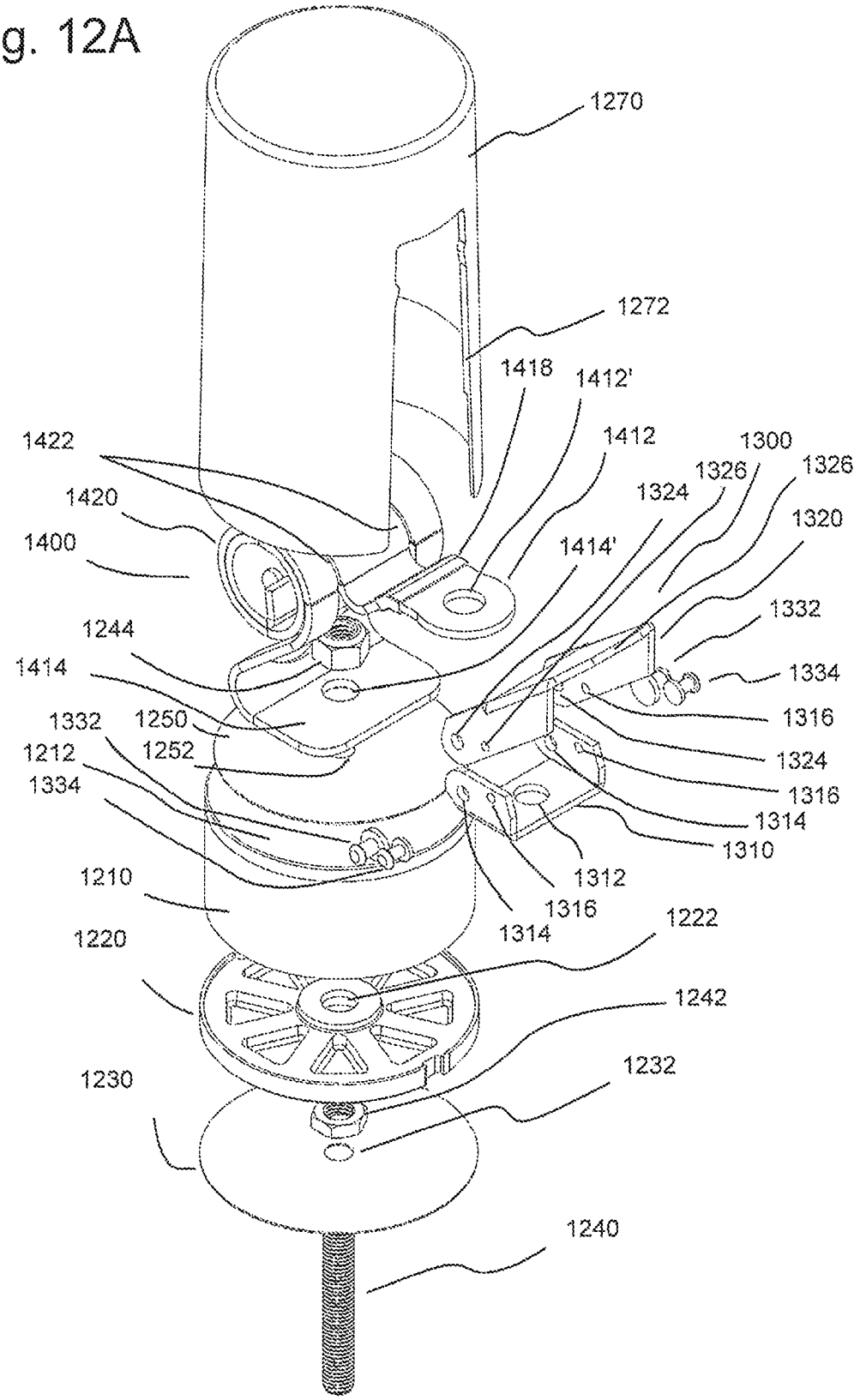
FIG. 12A illustrates an exploded or disassembled perspective view of the post system of FIG. 11A.

Support 1300 also includes an actuating mechanism or actuator that is operative to maintain a first end 1326 of second member 1320 in a first or raised position (see, for example, FIGS. 11A through 11C). In the illustrated embodiment, the actuator includes at least one shearable or breakable connector which connects first member 1310 to second member 1320 to maintain first end 1326 of second member 1320 in the first or raised position. In the illustrated embodiment, second member 1320 is connected to first member 1310 via two shearable or breakable connectors 1334 such as rivets. Shearable connectors 1334 pass through passages 1316 and 1326 in first member 1310 and second member 1320, respectively, to maintain first end 1326 of second member 1320 in the first or raised position. When a threshold force F is experience in line 510 (see FIG. 13A), shearable connectors 1334 shear or break and second member 1320 pivots relative to first member 1310 (about connectors 1332) such that first end 1326 of second member 1320 pivoted to a second or lower position (see, for example, FIG. 13B).

In the illustrated embodiment, post system 1200 includes an energy absorbing system or energy absorber 1400 to further limit forces upon the roof or other structure as well as to reduce force experienced by the user. Similar to post system 200, energy absorber 1400 can, for example, be an energy absorber the same as or similar to the energy absorbers disclosed in US Published Patent Application No. 2009/1094366. Other types of energy absorbers can be used in post system, however. Energy absorber 1400 includes opposing connector ends 1412 and 1414 having end connectors in the form of passages 1412' and 1414', and a coiled intermediate section 1420. As described in connection with energy absorber 110, upon application of a tensile force to ends 1412 and 1414, energy is absorbed via uncoiling/deformation and/or tearing in coiled section 1420 (for example, along grooves 1422) as ends 1412 and 1414 are pulled away from each other, lengthening energy absorber 1400 (see FIGS. 13C and 13D).

Figure 13B:
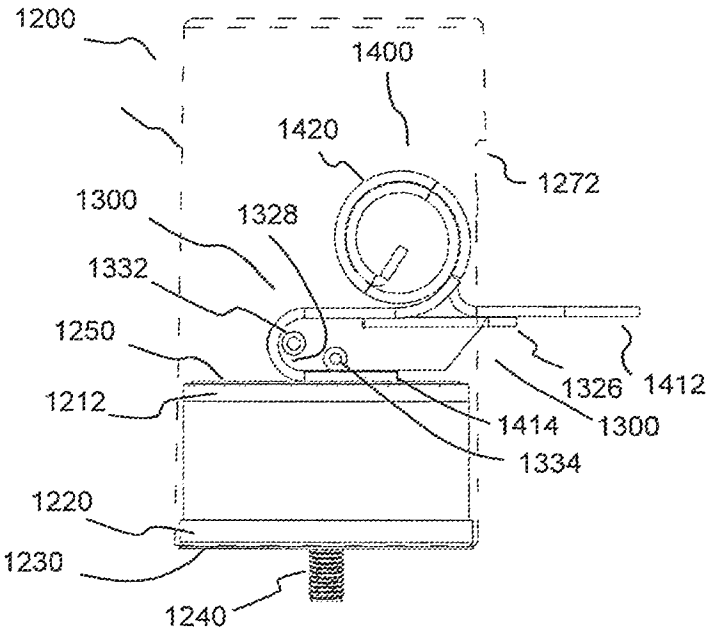
FIG. 13B is a side view of the post system of FIG. 11A with the cover removed and the moveable member of the support in a second position to lower the lifeline to a second, lower height after the threshold force has been experienced.
Figure 13A:
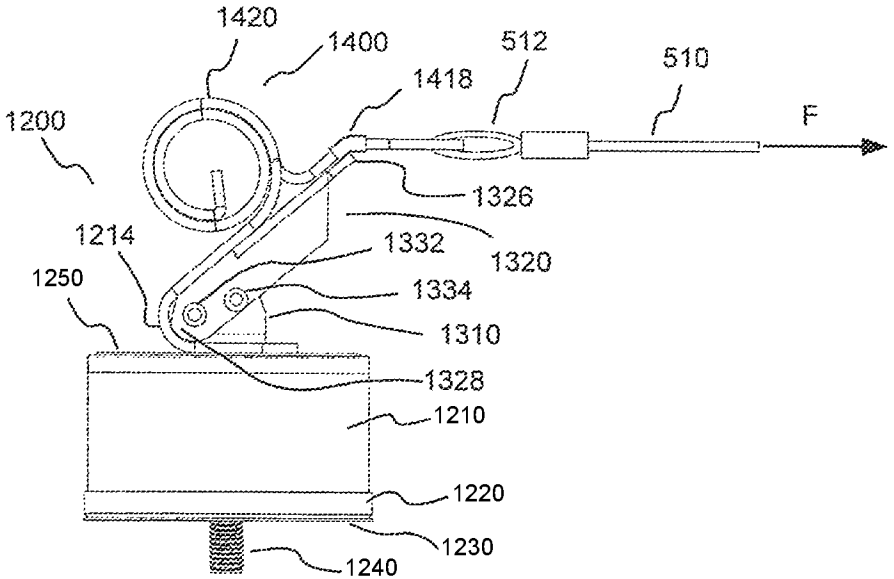
FIG. 13A is a side view of the post system of FIG. 11A with the cover removed and the moveable member of the support in the first position.

In the illustrated embodiment, first end 1412 extends over first end 1326 of second or moveable member 1320 to connect with line 510 via passage 1412', which cooperates with a connector 512 (see FIG. 13A). Second end 1414 of energy absorber 1400 extends around a second end 1328 of second member 1320, which can be arced or rounded. Second end 1414 of energy absorber 1400 is positioned adjacent a seal member 1250 (for example, an elastomeric seal member), which is positioned on top of second end member 1212 of post system 1200. Threaded connector 1240 passes through a passage 1252 in seal member 1250 and passes through passage 1414' of first end 1414 of energy absorber 1400. Threaded connector 1240 then passes through passage 1312 of first member 1310 of support 1300. A connector 1244 (for example, a bolt) is connected to the upper end of threaded connector 1240 to retain support 1300 and energy absorber 1400 in connection with post member 1210.

A cover or cap 1270 (which can, for example, be formed from a polymeric material such as polyethylene) is positioned over post member 1210 to, for example, protect the operational elements of post system 1200 during normal use. Cover 1270 can, for example, be sacrificed when threshold force is exceeded. In the illustrated embodiment, cover 1270 includes an extending opening or slot 1272 through which first end 1326 of second member 1320 of support 1300 and first end 1412 of energy absorber 1400 can extend. Projections 1272 provide a semi-positive retention in conjunction with members 1210 and 1220 from FIG. 12A to assist in retaining cap 1270 un operative connection with post member 1210. In a number of embodiments, a band 1418 of polymeric material was placed (for example, via shrink wrapping) around a portion of first end 1412 in the vicinity of first end 1412 which comes into contact with slot 1272 to prevent metal-to-polymer contact and associated wear and to assist in retention of cover 1270.

Slot 1272 extends longitudinally in cover 1272 to provide for movement (lowering) of second member 1320 and first end 1412 of energy absorber 1400 upon experiencing threshold force F. FIGS. 13A through 13D illustrate the movement of support 1300 from a non-actuated state (FIG. 13A) to an actuated state (FIG. 13B) upon line 510 experiencing a threshold force F or load. In a number of embodiments, threshold force or load F was approximately 1100 pounds-force (approximately 4.89 kiloNewtons). As described above, at the threshold force or load F, shearing or breaking connector(s) 1334 shear, and second member 1320 pivots about connectors 1332 to lower first end 1326 to a second or lower position as illustrated in FIG. 13B.

Figure 13C:
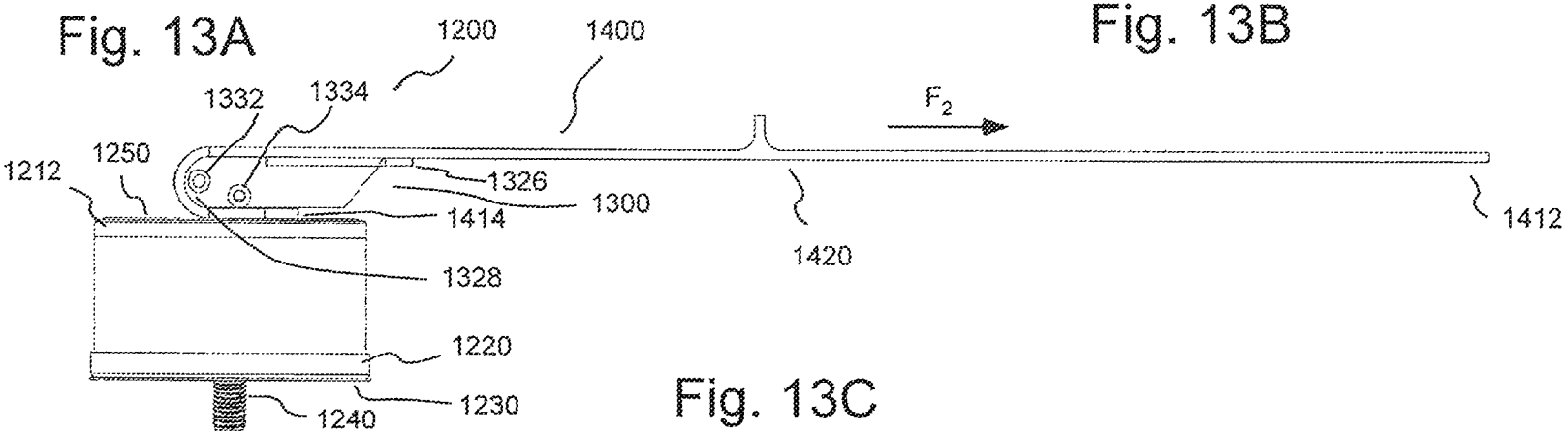
FIG. 13C is a side view of the post system of FIG. 11A with the cover removed and the moveable member of the support in a second position, and wherein an energy absorber has been actuated and deformed to a fully extended state after the lifeline experiences a second threshold force.
Figure 13D:
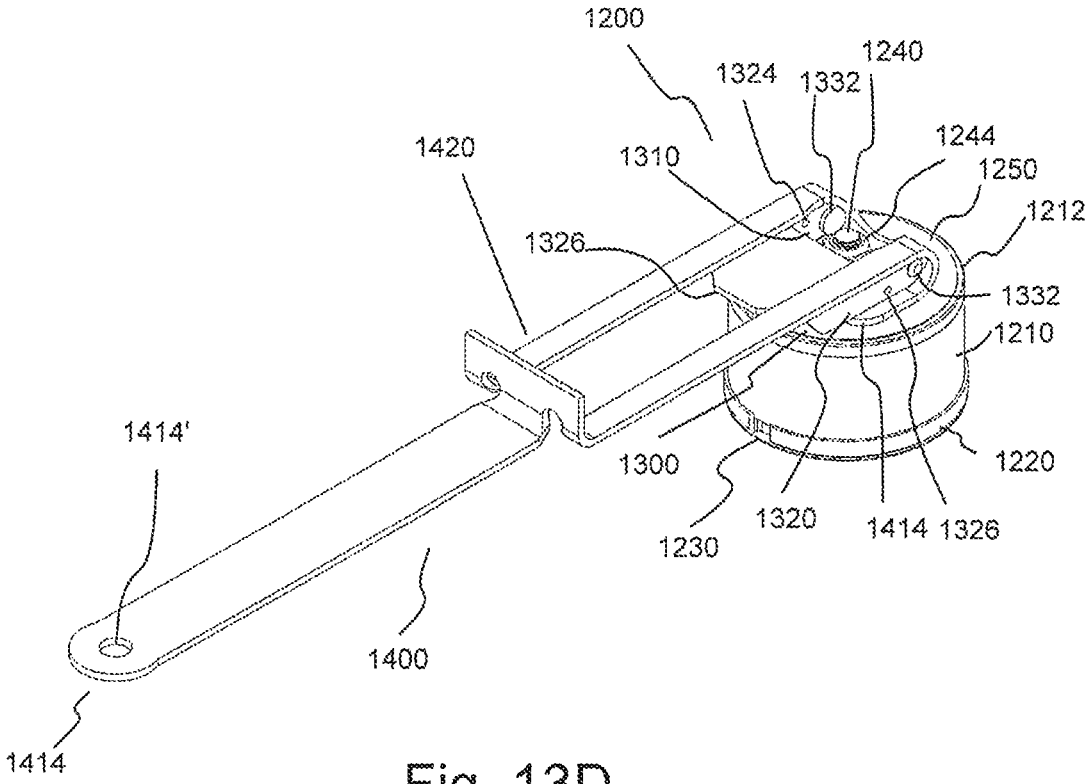
FIG. 13D is a perspective view of the post system of FIG. 11A with the cover removed and the moveable member of the support in a second position, and wherein an energy absorber has been actuated and deformed to a fully extended state after the lifeline experiences the second threshold force.

In a number of embodiments, energy absorber 1400 does not activate to absorb energy (via, for example, uncoiling/deforming and/or tearing) until a second threshold force or load $F_2$, which is greater than first threshold force or load F. In a number of embodiments, second threshold force or load $F_2$ was approximately 2200 pounds (approximately 9.79 kiloNewtons). FIGS. 13C and 13D illustrate energy absorber 1400 in a fully extended state.

Support 1300 can, for example, operate as a load indicator by indicating that post system 1200 has experienced threshold force or load F. Even though energy absorber 1400 does not activate to absorb energy at threshold force or load F, the observable activation of support system 1300 can indicated that system 1200 should undergo inspection and/or replacement/repair.

Support system 1300 and energy absorber may, for example, be pivotable or rotatable around connector 1240 to align with the orientation of lifeline 510.

Figure 14A:
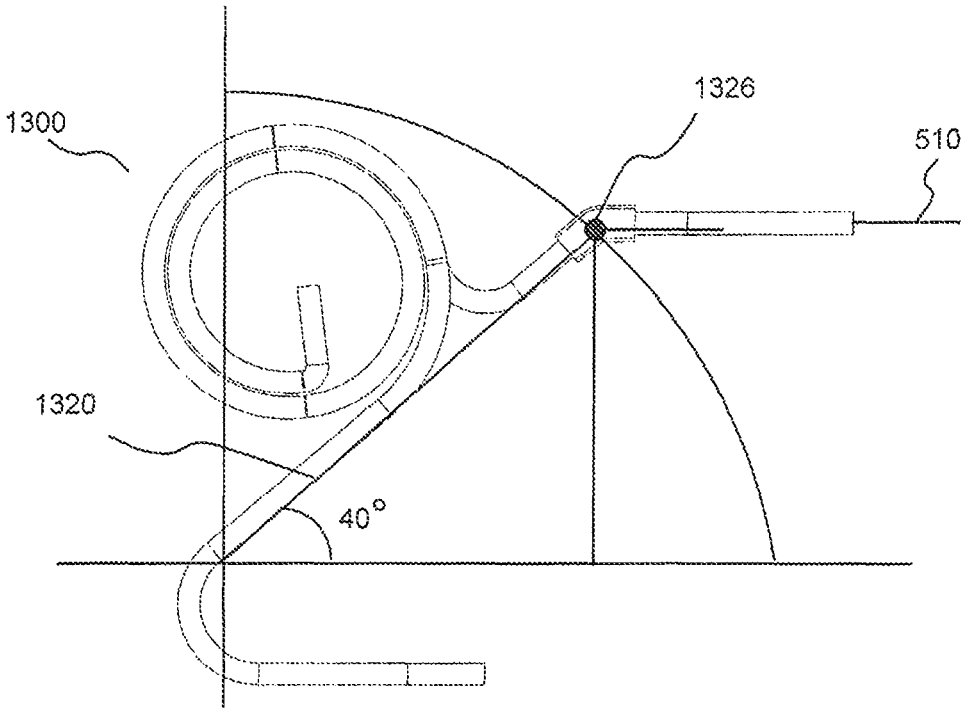
FIG. 14A illustrates is a side view of the moveable member of the support and the energy absorber (illustrated schematically) of the post system of FIG. 11A in the first position at an angle of approximately 40°.
Figure 14B:
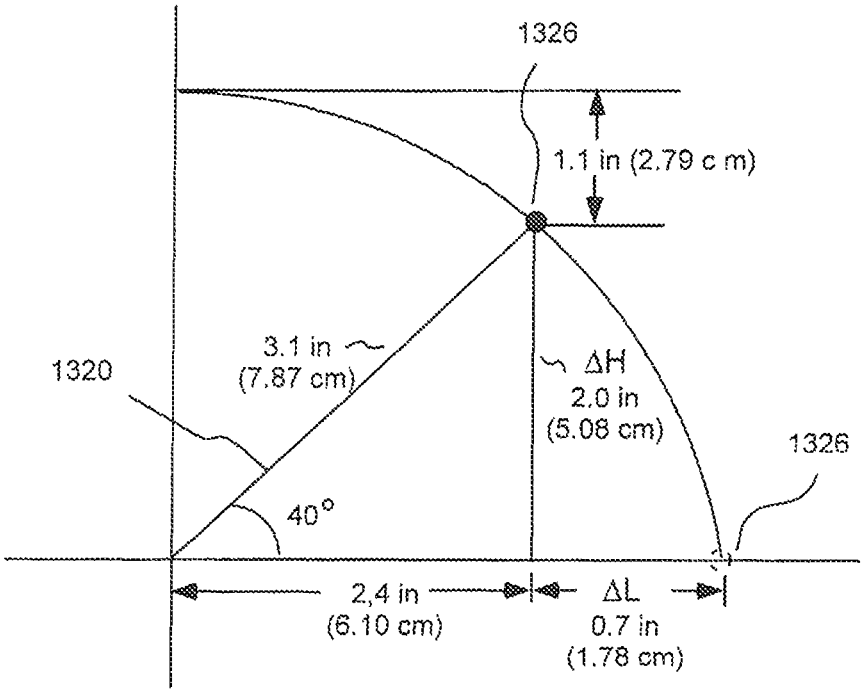
FIG. 14B illustrates graphically the change in height $\Delta H$ and the change in length $\Delta L$ associated with one embodiment of the support and energy absorber system of the post system of FIG. 11A.

FIGS. 14A through 15B provide a comparison of the operation of post system 200 and post system 1200 with respect to the change in height of lifeline 510 and the associated increase in the effective length of lifeline 510. FIG. 14A illustrates energy absorber 1400 as maintained by second member 1320 of support 1300 (represented schematically as line 1320 in FIG. 14A) at an approximately 40° angle with respect to the horizontal (or with respect to the general orientation of lifeline 510. FIG. 14B illustrates an analysis of the decrease in height (ΔH) of lifeline 510 and the associated increase in the effective length (ΔL) of lifeline 510. In the embodiment illustrated in FIG. 14A, the upper surface of second member 1320 extends at an angle of approximately 40° and has a length of approximately 3.1 inches (7.87 cm). In this embodiment, As described above, at the threshold force or load F, shearing or breaking connector(s) 1334 (not shown in FIG. 14B) shear, and second member 1320 pivots to lower first end 1326 to a second or lower position (that is, the generally horizontal or 0° position as illustrated in FIG. 14B). As illustrated in FIG. 14B, change in height ΔH of first end 1326 (and thereby the change in height of lifeline 510) is 2.0 inches (5.08 cm). As second member 1320 pivots downward, second end 1326 moves to the left (in the orientation of FIGS. 14A through 14C) distance ΔL to 0.7 inches (1.78 cm) which corresponds to the effective increase in the length of lifeline 510 associated with the pivoting of second member 1320 (and thereby the pivoting of energy absorber 1300). The ratio of the effective length change ΔL to the change in height ΔH can be adjusted by, for example, changing the angle of second member 1320. For example, if second member 1320 were placed in a vertical orientation, the height change ΔH would be equal to the length of second member 1320 or 3.1 inches (7.87 cm). The associated change in effective length ΔL would also be 3.1 inches. The ratio of change in effective length ΔL to change in effective height ΔH in the case of a vertical orientation of second member 1320 is thus 3.1/3.1 or 1.0, whereas the ratio for the case the second member 1320 is maintained at an angle of 40° is 0.7/2.0 or 0.35.

Figure 14C:
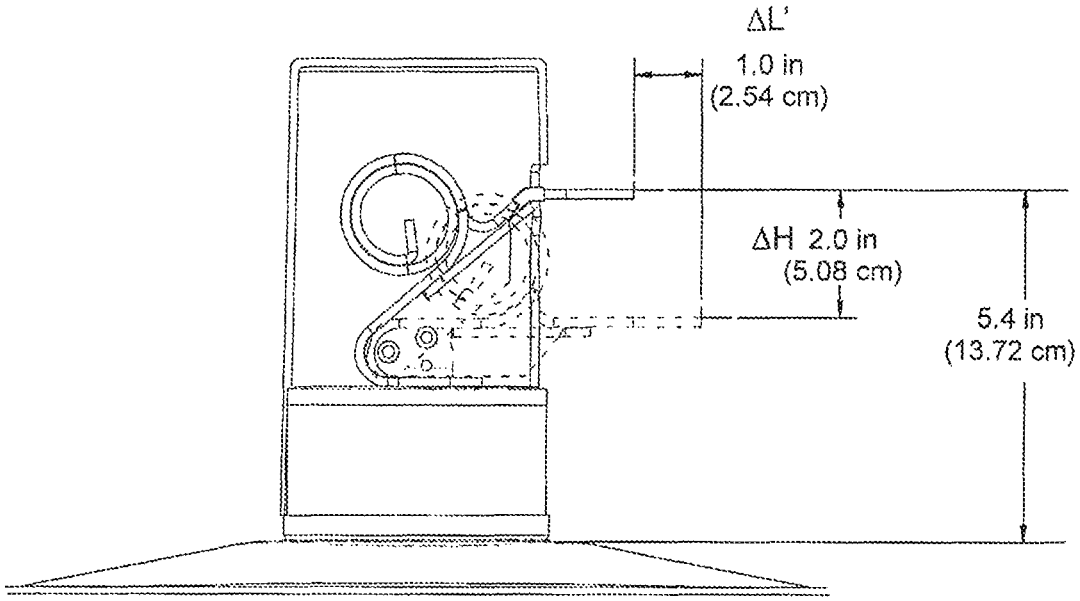
FIG. 14C illustrates the change in height $\Delta H$ and the change in length $\Delta L'$ (which includes a change in length associated with some deformation of the energy absorber) associated with one embodiment of the post system of FIG. 11A.

FIG. 14C illustrates ΔL and ΔH for the embodiment of FIGS. 14A and 14C wherein an increase in effective length of line 510 resulting from a straightening of a bend in the vicinity of connector end 1412 is included in ΔL'. In the illustrated embodiment, a change in effective length of 0.3 inches (0.8 cm) result from the straightening of that bend, resulting in an overall ΔL' of 1.0 inches (2.54 cm). The change in effective length of lifeline 510 increases further upon elongation of coiled intermediate section 1420 of energy absorber 1400.

Figure 15B:
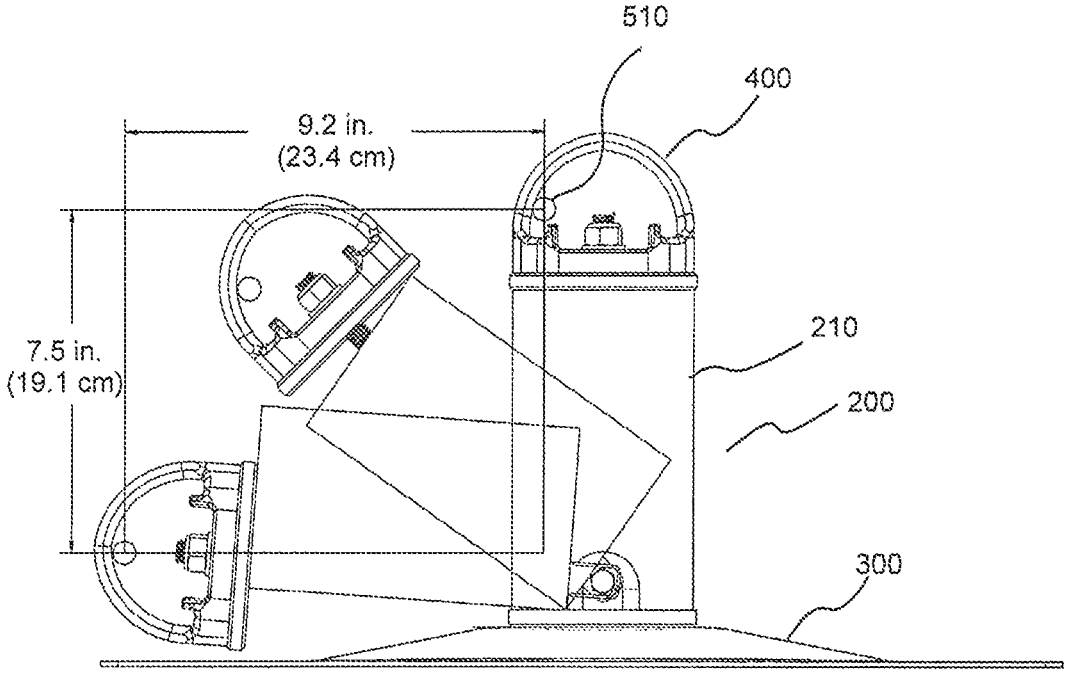
FIG. 15B illustrates another side view of a post system including a tipping, generally cylindrical post member with the post member in various positions.
Figure 15A:
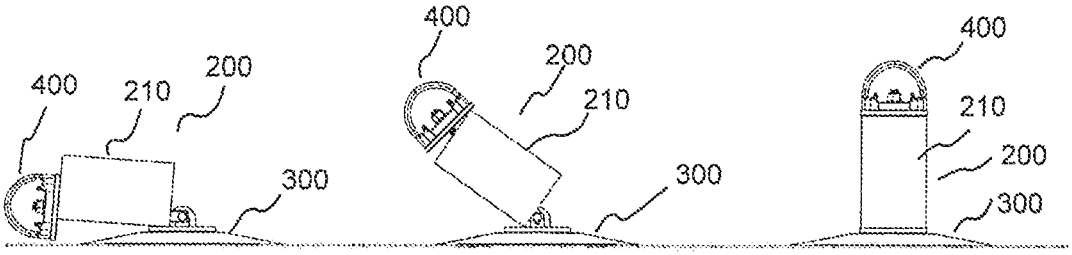
FIG. 15A illustrates a side view of a post system including a tipping, generally cylindrical post member and a study of the change in height $\Delta H$ and the change in length $\Delta L$ associated with tipping of the post member.

FIGS. 15A and 15B illustrate, for comparison, ΔL and ΔH for post system 200 upon tipping of post member 210, prior to elongation of energy absorber 110 (not shown in FIGS. 15A and 15B) for a typical tipping scenario. In the illustrated embodiment, ΔL is approximately 9.2 inches (23.4 cm) and ΔH is approximately 7.5 inches (19.1 cm). The ration of ΔL/ΔH is thus 1.23 (9.2/7.5). As described above, in certain circumstances, it is desirable to limit the increase in effective line length and thereby the potential vertical fall of one or more users. End post systems such as end post systems 200' and 1200 provides for lowering of the height a lifeline to reduce torque (to reduce, minimize or prevent damage to the roof or other structure to which such post systems are attached) while limiting the change in effective length of the lifeline associated with the lowering in height thereof.

FIGS. 16A through 16F illustrate another embodiment of a system including a support 1600 which can, for example, be attached to upper end member 1212 via connector 1244 as described above in connection with support 1600. In the illustrated embodiment, connector 1244 cooperates with a first member 1610 of support 1600 including a first section 1614 which extends generally parallel to upper end member 1212 of post member 1210 (not shown in FIGS. 16A through 16F). First member 1610 of support 1600 further includes an extending second section 1620 which operates to position the height of lifeline 510 to a first height (see FIGS. 16B and 16D). In the illustrated embodiment extending second section 1620 extends at an angle α with respect to first section 1614 (see FIG. 16B) for at least a portion thereof to position lifeline 1510 at the first height. First section 1614 and second section 1620 of first member 1610 can, for example, be formed monolithically from a length of a metal or other material (for example, steel or stainless steel) which is bent or otherwise formed as illustrated.

Support 1600 further includes a second member 1630 in operative attachment with first member 1620. Second member 1630 includes a connector 1632 for attachment of lifeline 510 thereto. In the illustrated embodiment, connector 1632 is a passage formed through a first end section 1634 of second member 1630. In the illustrated embodiment, second member 1630 is connected to first member 1610 via a shearable or breakable connector 1650 (for example, a shear pin) which passes through a passage 1622 in second section 1620 of first member 1610 and a passage 1638 in third member 1630 (see FIG. 6E). Second member 1630 further includes an intermediate section 1642 which extends through a slot 1624 formed in second section 1620 of first member 1610. Intermediate section 1640 is connected to a second end section 1644 of second member 1630. In the illustrated embodiment, intermediate section 1640 is curved or bent. Second end section 1640 is dimensioned so that it cannot pass through slot 1624. Second end section 1640 can be formed separately and connected to intermediate section 1640 (for example, via welding) or can be formed monolithically therewith. In the illustrated embodiment, intermediate section 1640 curves to rest on bolt 1244 to provide further support for second section 1620.

In the illustrated embodiment, slot 1624 includes a plurality of strips 1626 or "sharks teeth" extending across the width thereof. Strips or sharks teeth 1626 can, for example, be formed monolithically with the other components of first member 1610 (for example, from a material such as steel or stainless steel).

Figure 16A:
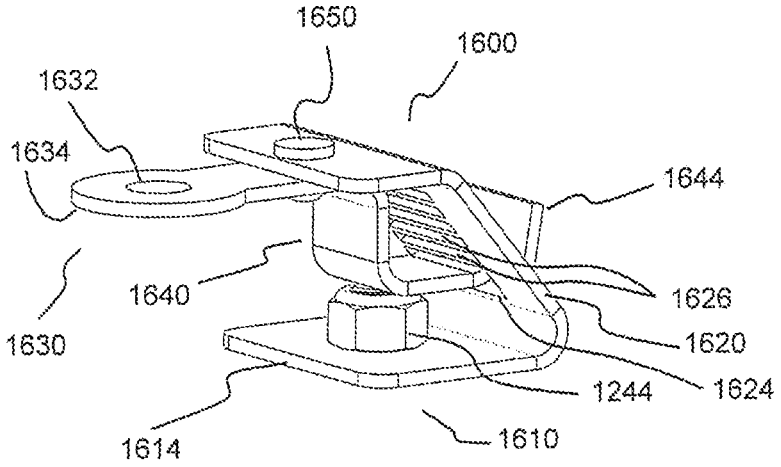
FIG. 16A illustrates a perspective view of another embodiment of a support system and energy absorber system with the support in a non-actuated state to maintain the lifeline at a first, higher position, before a threshold force has been experienced.
Figure 16B:
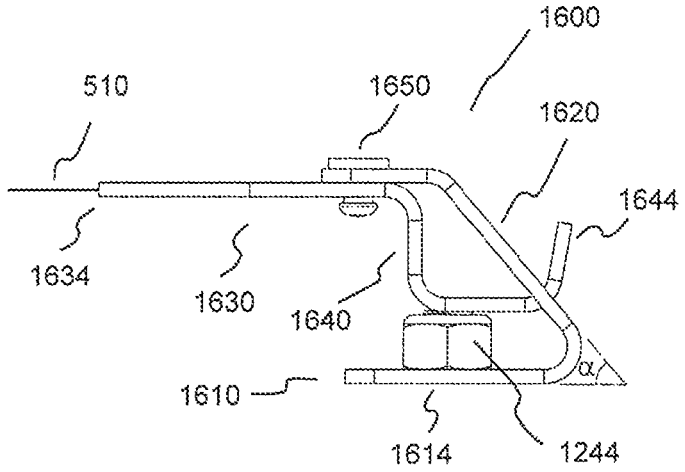
FIG. 16B illustrates a side view of the support system and energy absorber system of FIG. 16A.
Figure 16C:
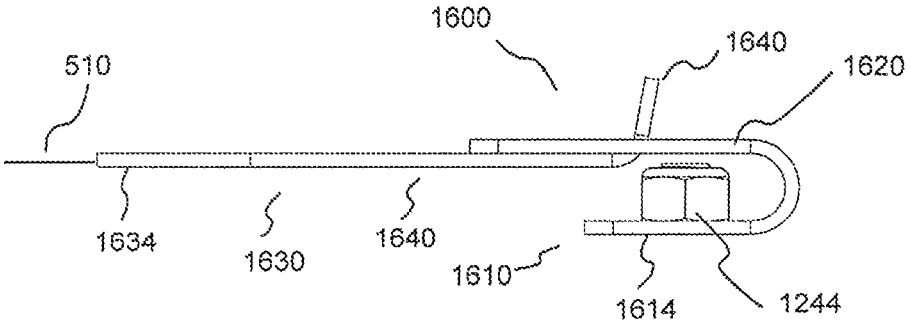
FIG. 16C illustrates a side view of the support system and energy absorber system of FIG. 16A wherein the support has actuated upon experiencing a threshold force and lowered the lifeline to a second, lower position and the energy absorber has actuated to absorb energy.
Figure 16D:
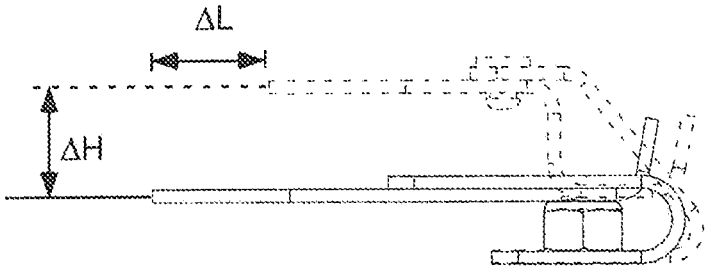
FIG. 16D illustrates a side view of the support system and energy absorber system of FIG. 16A in a non-actuated state (broken lines) and in an actuated stated wherein the support has actuated upon experiencing a threshold force and lowered the lifeline to a second, lower position, and wherein the energy absorber has not been actuated to absorb energy.
Figure 16E:
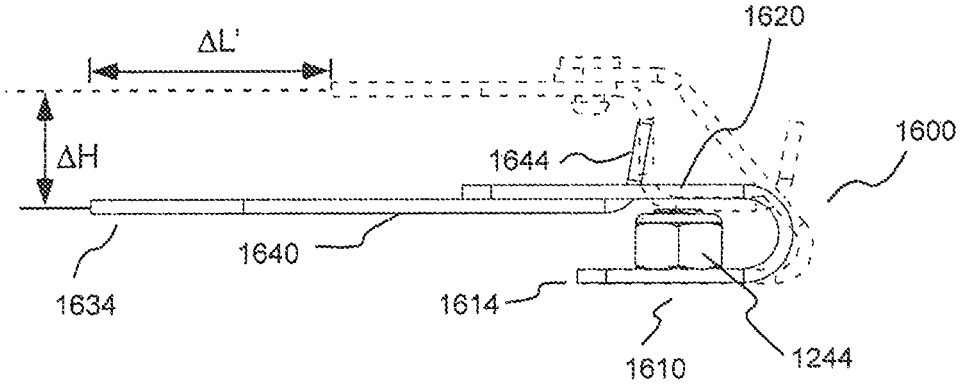
FIG. 16E illustrates a side view of the support system and energy absorber system of FIG. 16A in a non-actuated state (broken lines) and in an actuated stated wherein the support has actuated upon experiencing a threshold force and lowered the lifeline to a second, lower position, and wherein the energy absorber has actuated to absorb energy.
Figure 16F:
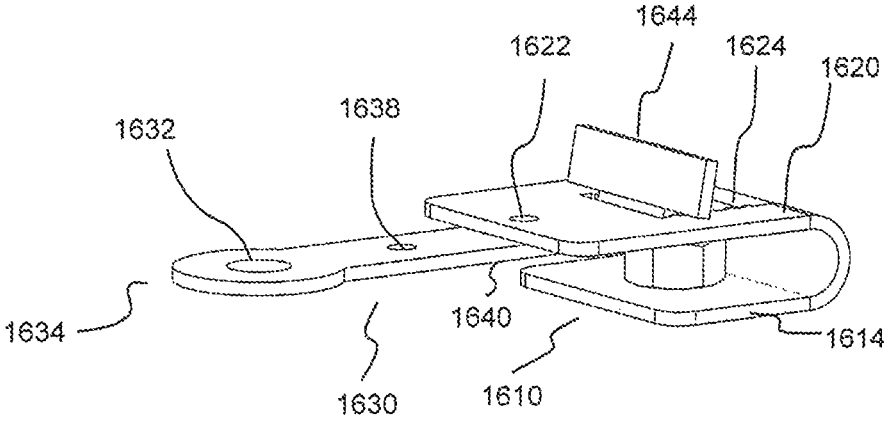
FIG. 16F illustrates a perspective view of the support system and energy absorber system of FIG. 16A in an actuated stated wherein the support has actuated upon experiencing a threshold force and lowered the lifeline to a second, lower position and the energy absorber has actuated to absorb energy.

In the case of a threshold force F in lifeline 510, breakable connector 1650 breaks or shears. Upon breaking of connector 1650, force in lifeline 510 causes second section 1620 of first member 1610 to bend or deflect as illustrated in FIGS. 16C through 16F to lower the height of lifeline 510 to a second lower position (see FIGS. 16C and 16D). Second member 1630 also bends or deflects as illustrated in FIGS. 16C through 16F. Further, force in lifeline 510 causes intermediate section 1640 to deform and break or tear strips 1626, thereby absorbing energy. The change in lifeline height ΔH and the change in effective lifeline length ΔL associated with deformation of first member 1610 to lower the height of lifeline 510 from the first higher position to the second lower position, a distance ΔH, is illustrated in FIG. 16D. The total change in effective line length ΔL' associated with the deformation of first member 1610, including the breaking of strips 1626, and the deformation of second member 1620 is illustrated in FIG. 16E. The bending/straightening of first member 1610 and the bending/straightening of second member 1630 associated with lowering the height of lifeline 510 can, for example, occur the threshold force discussed above and the tearing of sharks teeth 1626 (to absorb energy) can occur at a second, higher threshold force.

Figure 17A:
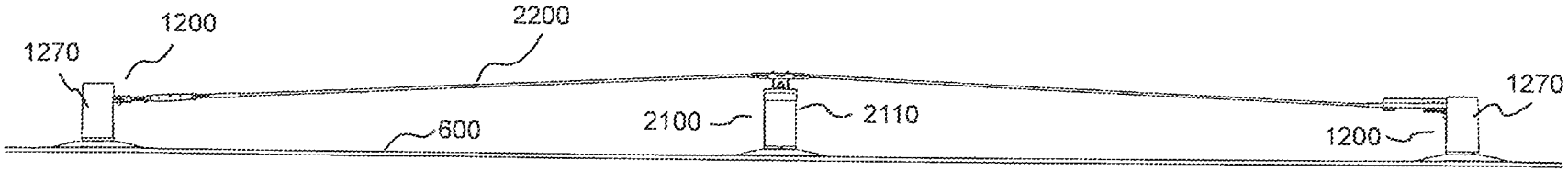
FIG. 17A illustrates a side view of a span of a horizontal lifeline system including end posts (at the ends of the illustrated span) as illustrated in FIG. 12A and an intermediate post including a tipping post member.
Figure 17B:
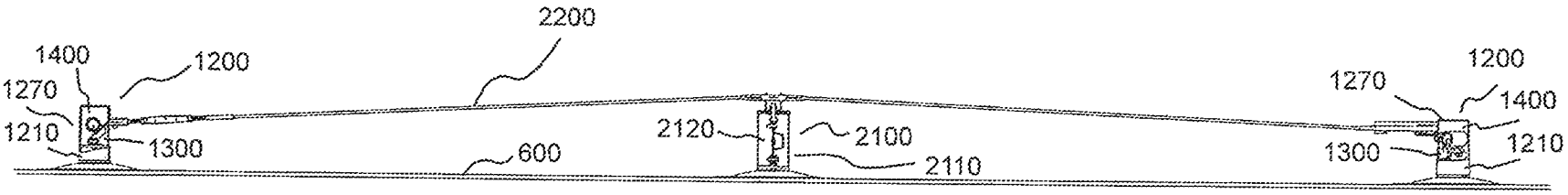
FIG. 17B illustrates a side, cross-sectional view the span of the horizontal lifeline system of FIG. 17A.
Figure 17C:
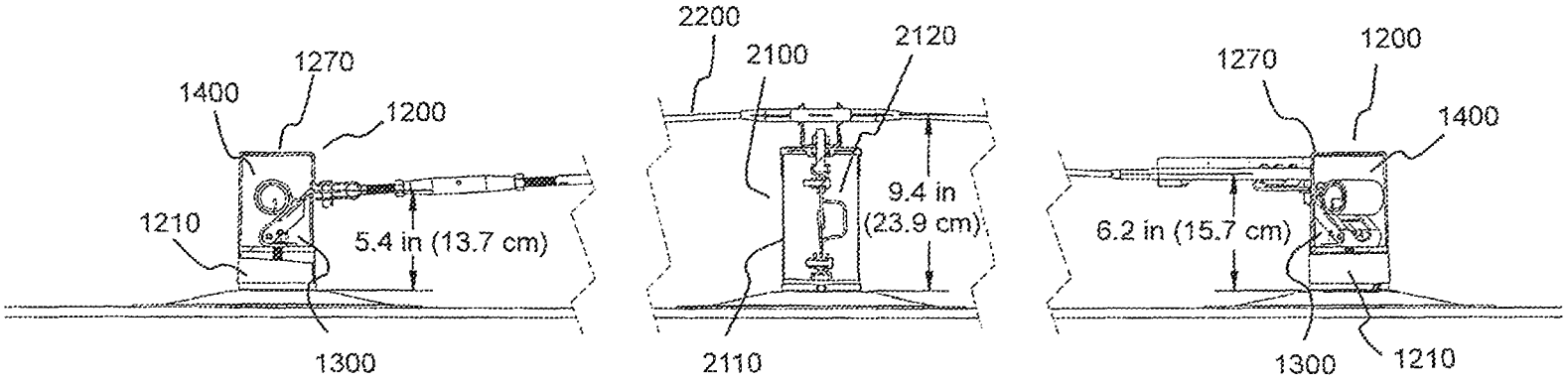
FIG. 17C illustrates an enlarged side, cross-sectional view the span of the horizontal lifeline system of FIG. 17A.

FIGS. 17A through 17C illustrated an embodiment of a horizontal lifeline system 2000 including end post systems 1200 as described above. Horizontal lifeline system 2000 also includes one or more intermediate post systems 2100. Intermediate post system can, for example, include a tipping post member 2110. In the case of an intermediate post which is in line (for example, less than 22° trajectory change) with the posts on either side of the intermediate post, a tipping post member, which has a ΔL/ΔH ratio of equal to or greater than 1, does not add or does not add significantly to the effective length of lifeline 2200. Intermediate post system 2100 can, for example, be a post system as described in U.S. Provisional Patent Application Ser. No. 61/372,643, assigned to the assignee of the present application, the disclosure of which is incorporated herein by reference. Post system 2100 includes an energy absorber 2120 which actuates to both allow tipping of post member 2110 and to absorb energy as described in U.S. Provisional Patent Application Ser. No. 61/372,643. In horizontal lifeline system 2000, intermediate post system 2100 raises lifeline 2200 to a greater height that the height to which end post systems 1200 raise lifeline 2200. In the illustrated embodiment, end post systems 1200 raise lifeline 2200 to approximately 5.4 in (13.7 cm) and approximately 6.2 in (15.7 cm), while intermediate post system 2100 raises lifeline to approximately 9.4 in (23.9 cm). Intermediate post system 2100 assists in raising lifeline 220 above structure 600 to, for example, facilitate use thereof without resulting in a substantial increase in effective length of lifeline 2200 in the case of a fall.

Figure 18A:
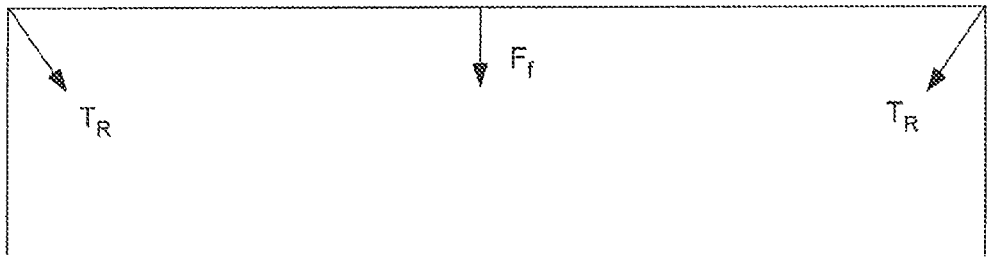
FIG. 18A illustrates a top view of a portion of a horizontal lifeline system including two 90° changes in angle.
Figure 18B:
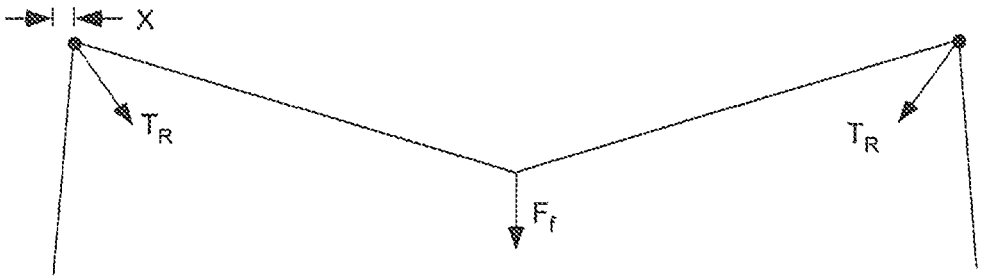
FIG. 18B illustrates a change in effective line length at the center of the span associated with a change in position of x at the corners of the span resulting from a fall force at the center of the span.
Figure 18C:
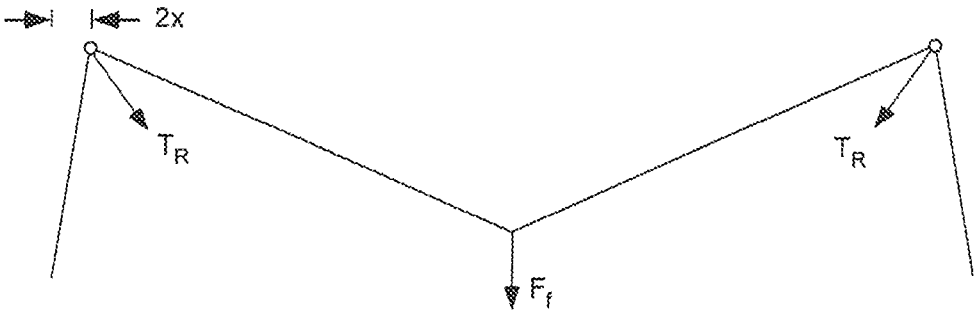
FIG. 18C illustrates a significantly greater a change in effective line length at the center of the span as compared to FIG. 18B associated with a change in position of 2x at the corners of the span resulting from a fall force at the center of the span.
Figure 18D:
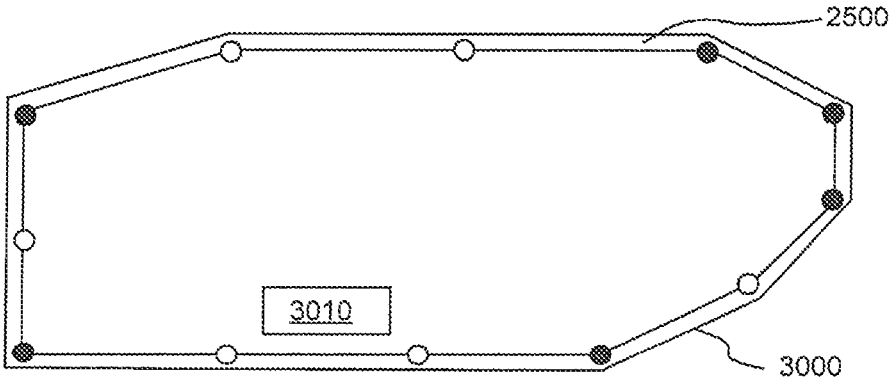
FIG. 18D illustrates a top view of an embodiment of a horizontal lifeline system wherein posts including tipping post member and having a $\Delta L/\Delta H$ ratio equal to or greater than 1 are illustrated schematically as open circles and posts having a $\Delta L/\Delta H$ ratio less than 1 are illustrated schematically as filled circles.

FIG. 18A illustrates a top view of a portion of a horizontal lifeline system including two 90° changes in angle or corners. FIG. 18B illustrates a change in effective line length at the center of the span associated a change in position of x at the corners of the span upon a fall force $F_f$ at the center of the span. FIG. 18C illustrates a significantly greater change in effective line length at the center of the span associated a change in position of 2x at the corners of the span. As shown in both FIGS. 18B and 18C, the resultant vector from line tension $T_R$ in the case of a fall moves the line inward, which effectively moves the end points of the spans closer while leaving the actual length of the line unchanged. In general, the greater the angle at a corner (that is, a change in angle or trajectory) of a horizontal lifeline, the greater the change in effective line length associated with a given change in position (for example, associated with a tipping post) of the corner point. Design constraints known to those skilled in the art (for example, design constraints including fall length/fall clearance associated with a personal lifeline/energy absorbing system of a user) dictate allowable line deflection and therefore dictate the maximum allowable increase in effective line length. The allowable increase in effective line length thus determines the allowable angle which can be used with a post exhibiting a certain ΔL/ΔH. At a certain predetermined angle, readily determined by those skilled in the fall protection arts from known system constraints using known engineering principles, posts having a ΔL/ΔH ratio less than 1, less than 0.5 or even less than 0.4 are desirable to minimize increases in effective line length. FIG. 18D illustrates a top view of an embodiment of a horizontal lifeline system 2500 extending around a perimeter of a roof/structure 3000 wherein posts including a tipping post member and having a ΔL/ΔH ratio equal to or greater than 1 are illustrated as open circles and posts having a ΔL/ΔH ratio less than 1 are illustrates as filled circles. At corners (or changes in angle) of horizontal lifeline 2500 wherein the associated change in angle is greater than a predetermined angle (for example, 22° in a number of embodiments) posts having a ΔL/ΔH ratio less than 1 are used. For posts wherein the change in angle is less than the predetermined angle, posts have ΔL/ΔH equal to or greater than 1 are used. Posts hereof used as intermediate posts can include intermediate connectors for the lifeline as known in the fall protection arts. In general, the line tension within the lifeline discussed above in the case of a fall will result in an inward (with respect to the perimeter of roof 3000 and the horizontal lifeline system) force on the posts whether a user falls outside the perimeter or inside the perimeter (for example, falls through a skylight 3010).

In the embodiments described above, a support such as support 1300 is positioned upon a post member or other raised member. However, a support hereof can also be attached directly to a structure such as structure 600.

Furthermore, a support hereof can, for example, include or be formed by a post member that tilts to lower a lifeline. For example, the post member can be angled such that is not initially oriented generally vertically or generally perpendicular to the lifeline to thereby provide a ΔL/ΔH ratio less than 1 (upon tilting or tipping to lower the lifeline).

The foregoing description and accompanying drawings set forth a number of representative embodiments at the present time. Various modifications, additions and alternative designs will, of course, become apparent to those skilled in the art in light of the foregoing teachings without departing from the scope hereof, which is indicated by the following claims rather than by the foregoing description. All changes and variations that fall within the meaning and range of equivalency of the claims are to be embraced within their scope.

What is claimed is:

1. An apparatus comprising:

a band of material configured to be coupled to a support structure at a first end and a lifeline at a second end, the band of material further configured to transition from a wound configuration to an open configuration in response to experiencing a tensile force that satisfies a threshold tensile force, wherein the band of material comprises at least one slot oriented longitudinally along at least a portion of a length of the band of material such that, in an instance in which the band of material transitions from the wound configuration to the open configuration, the at least one slot is configured to fail and at least a portion of the band of material is configured to deform to absorb energy, and an actuator circumscribing the band, wherein a first end of the actuator is connected with a second end of the actuator via connectors to provide a threshold opening force, wherein an intermediate section of the band of material comprises a first path of relatively reduced strength beginning at a first end of the at least one slot and forming a generally U-shaped slot and a second path of relatively reduced strength beginning at a second end of the generally U-shaped slot, wherein the first path and the second path are in the form of two grooves and a second intermediate section which begins at transition points and extend to points which are spaced from a second end section of the strap, wherein the band of material has end portions disposed in a common plane, the common plane passing through a center portion of the band of material in the wound configuration, and wherein the threshold opening force causes the connectors of the actuator to open, and actuate the apparatus for energy absorption.

2. The apparatus of claim 1, wherein the band of material comprises a metal strap, the metal strap comprising a first end section and a second end section, wherein at least a portion of the intermediate section is coiled inside a remainder of the intermediate section in an instance in which the band of material is in the wound configuration, wherein the at least one slot comprises the generally U-shaped slot passing through the metal strap in the first end section that separates the first end into a first connector section and a second connector section, the first connector section and the second connector section being configured to extend in different directions away from one another in an instance in which the generally U-shaped slot fails, such that the band of material deforms to absorb energy.

3. The apparatus of claim 2, wherein tearing occurs along the first path and the second path upon deformation of the metal strap.

4. The apparatus of claim 2, wherein the band of material is held in the wound configuration or the at least one slot is prevented from failing via at least one breakable connector that breaks upon one of the tensile force satisfying the threshold tensile force or a reduced threshold tensile force having a magnitude less than the threshold tensile force.

5. A post system for use in fall protection, comprising:

an extending post member, a first end member in operative connection with a first end of the extending post member;

a second end member in operative connection with a second end of the extending post member;

a first connector in operative connection with the first end member to connect a lifeline system to the first connector;

a second connector in operative connection with the second end member to connect the second end member to a structure; and at least one energy absorbing apparatus in operative connection between the first end member and the second end member, the at least one energy absorbing apparatus comprising a band of material in operative connection with the first connector and the second connector, the band of material being configured to transition from a wound configuration to an open configuration in response to experiencing a tensile force satisfying a threshold tensile force between the first end member and the second end member, the band of material comprising at least one slot oriented longitudinally along at least a portion of a length of the band of material, wherein, in an instance in which the band of material transitions from the wound configuration to the open configuration, the at least one slot is configured to fail, allowing at least a portion of the band of material to deform to absorb energy, and allowing the extending post member to tilt relative to the second end member to further absorb energy, and an actuator circumscribing the band, wherein a first end of the actuator is connected with a second end of the actuator via connectors to provide a threshold opening force, wherein an intermediate section of the band of material comprises a first path of relatively reduced strength beginning at a first end of the at least one slot and forming a generally U-shaped slot and a second path of relatively reduced strength beginning at a second end of the generally U-shaped slot, wherein the first path and the second path are in the form of two grooves and a second intermediate section which begins at transition points and extend to points which are spaced from a second end section of the strap, wherein the band of material has end portions disposed in a common plane, the common plane passing through a center portion of the band of material in the wound configuration, and wherein the threshold opening force causes the connectors of the actuator to open, and actuate the energy absorbing apparatus for energy absorption.

6. The post system of claim 5, wherein the band of material comprises a metal strap, the metal strap comprising a first end section and a second end section, wherein at least a portion of the intermediate section is coiled inside a remainder of the intermediate section in an instance in which the band of material is in the wound configuration, wherein the at least one slot comprises the generally U-shaped slot passing through the metal strap in the first end section that separates the first end into a first connector section and a second connector section, the first connector section and the second connector section being configured to extend in different directions away from one another in an instance in which the generally U-shaped slot fails, such that the band of material deforms to absorb energy.

7. The post system of claim 6, wherein tearing occurs along the first path and the second path upon deformation of the metal strap.

8. The post system of claim 5, wherein the band of material is held in the wound configuration or the at least one slot is prevented from failing via at least one breakable connector that breaks upon one of the tensile force satisfying the threshold tensile force or a reduced threshold tensile force having a magnitude less than the threshold tensile force.

9. The post system of claim 5, wherein the first connector comprises a first clevis assembly and the second connector comprises a second clevis assembly.

10. A horizontal lifeline system comprising:

at least one post system, comprising:

an extending post member;

a first end member in operative connection with a first end of the extending post member;

a second end member in operative connection with a second end of the extending post member;

a first connector in operative connection with the first end member to connect a lifeline system to the first connector;

a second connector in operative connection with the second end member to connect the second end member to a structure;

at least one energy absorbing apparatus in operative connection between the first end member and the second end member, the at least one energy absorbing apparatus comprising a band of material in operative connection with the first connector and the second connector, the band of material being configured to transition from a wound configuration to an open configuration in response to experiencing a tensile force satisfying a threshold tensile force between the first end member and the second end member, the band of material comprising at least one slot oriented longitudinally along at least a portion of a length of the band of material, wherein, in an instance in which the band of material transitions from the wound configuration to the open configuration, the at least one slot is configured to fail, allowing at least a portion of the band of material to deform to absorb energy, and allowing the extending post member to tilt relative to the second end member to further absorb energy, and an actuator circumscribing the band, wherein a first end of the actuator is connected with a second end of the actuator via connectors to provide a threshold opening force; and the horizontal lifeline system further comprising:

a lifeline attached to the post system, wherein an intermediate section of the band of material comprises a first path of relatively reduced strength beginning at a first end of the at least one slot and forming a generally U-shaped slot and a second path of relatively reduced strength beginning at a second end of the generally U-shaped slot, and wherein the first path and the second path are in the form of two grooves and a second intermediate section which begins at transition points and extend to points which are spaced from a second end section of the strap, wherein the band of material has end portions disposed in a common plane, the common plane passing through a center portion of the band of material in the wound configuration, and wherein the threshold opening force causes the connectors of the actuator to open, and actuate the energy absorbing apparatus for energy absorption.

11. The system of claim 10, wherein the band of material comprises a metal strap, the metal strap comprising a first end section and a second end section, wherein at least a portion of the intermediate section is coiled inside a remainder of the intermediate section in an instance in which the band of material is in the wound configuration, wherein the at least one slot comprises the generally U-shaped slot passing through the metal strap in the first end section that separates the first end into a first connector section and a second connector section, the first connector section and the second connector section being configured to extend in different directions away from one another in an instance in which the generally U-shaped slot fails, such that the band of material deforms to absorb energy.

12. The system of claim 11, wherein tearing occurs along the first path and the second path upon deformation of the metal strap.

13. The system of claim 10, wherein the band of material is held in the wound configuration or the at least one slot is prevented from failing via at least one breakable connector that breaks upon one of the tensile force satisfying the threshold tensile force or a reduced threshold tensile force having a magnitude less than the threshold tensile force.

14. The system of claim 10, wherein the first connector comprises a first clevis assembly and the second connector comprises a second clevis assembly.

15. The system of claim 12, wherein the intermediate section is configured such that, upon experiencing a tensile force satisfying a second threshold force greater than the threshold force, the metal strap is configured to tear along at least one of the first or second path of relatively reduced strength.

16. The system of claim 11, wherein an intermediate post system is positioned along the lifeline at a position wherein the lifeline forms an angle of less than a predetermined angle.

17. The system of claim 11, wherein the intermediate post system comprises a tilting post member.

* * * * *